US012140409B2

(12) United States Patent
Barnette

(10) Patent No.: US 12,140,409 B2
(45) Date of Patent: Nov. 12, 2024

(54) PIVOTING FIXED-BLADE ARROWHEAD WITH STATIONARY NOSETIP

(71) Applicant: Digital to Definitive, LLC, Austin, TX (US)

(72) Inventor: Darrel R. Barnette, Austin, TX (US)

(73) Assignee: DIGITAL TO DEFINITIVE, LLC, Austin, TX (US)

( * ) Notice: Subject to any disclaimer, the term of this patent is extended or adjusted under 35 U.S.C. 154(b) by 76 days.

(21) Appl. No.: 18/116,633

(22) Filed: Mar. 2, 2023

(65) Prior Publication Data

US 2023/0296359 A1 Sep. 21, 2023

Related U.S. Application Data

(60) Provisional application No. 63/320,744, filed on Mar. 17, 2022.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 4,807,889 A * 2/1989 Johnson ..... F42B 6/08 473/584
7,037,222 B2 * 5/2006 Mizek ..... F42B 6/08 473/583
7,182,706 B2 * 2/2007 Barrie ..... F42B 6/08 473/584
7,232,390 B2 * 6/2007 Mizek ..... F42B 6/08 473/583
7,338,397 B2 * 3/2008 Mizek ..... F42B 6/08 473/583
7,883,435 B2 * 2/2011 Sullivan ..... F42B 6/08 473/583
7,951,023 B2 * 5/2011 Perkins, Jr. ..... F42B 6/08 473/583
8,043,176 B2 * 10/2011 Byrne ..... F42B 6/08 473/578
8,096,905 B1 * 1/2012 Gillig ..... F42B 6/08 473/584
8,100,788 B2 * 1/2012 Sanford ..... F42B 6/08 473/582
8,506,431 B2 * 8/2013 Green ..... F42B 6/08 473/584
10,205,936 B2 * 2/2019 Powell ..... H04N 13/144

* cited by examiner

*Primary Examiner* — John A Ricci
(74) *Attorney, Agent, or Firm* — Bennet K. Langlotz; Langlotz Patent & Trademark Works, LLC

(57) ABSTRACT

An arrowhead assembly comprises a connector element configured to connect to a forward end of a shaft; an arrowhead body movably connected to the connector element; the arrowhead body including a center portion and a plurality of blades each extending from the center portion; the center portion movable axially with respect to the connector element between a forward position and a rearward position; when in the forward position the center position being constrained against lateral movement with respect to the connector element; and when in the rearward position the center position being enabled to move laterally with respect to the connector element.

2 Claims, 36 Drawing Sheets

PIVOTING FIXED-BLADE ARROWHEAD WITH STATIONARY NOSETIP

CROSS-REFERENCE TO RELATED APPLICATIONS

This application claims the benefit of U.S. Provisional Patent Application No. 63/320,744, filed on Mar. 17, 2022, entitled "PIVOTING FIXED-BLADE ARROWHEAD WITH STATIONARY NOSETIP", which is hereby incorporated by reference in its entirety for all that is taught and disclosed therein.

FIELD OF THE INVENTION

The present invention relates to arrowheads.

BACKGROUND AND SUMMARY

In the current disclosure, means by which a pivoting arrowhead may reduce or eliminate deflection is put forth which eliminates the need for immobilizing the arrowhead body with respect to the arrow shaft during the penetration event, and therefore reduces the overall complexity of the pivoting arrowhead.

The above disadvantage is addressed by an arrowhead assembly that comprises a connector element configured to connect to a forward end of a shaft; an arrowhead body movably connected to the connector element; the arrowhead body including a center portion and a plurality of blades each extending from the center portion; the center portion movable axially with respect to the connector element between a forward position and a rearward position; when in the forward position the center position being constrained against lateral movement with respect to the connector element; and when in the rearward position the center position being enabled to move laterally with respect to the connector element.

DETAILED DESCRIPTION OF A PREFERRED EMBODIMENT

Figure 1:
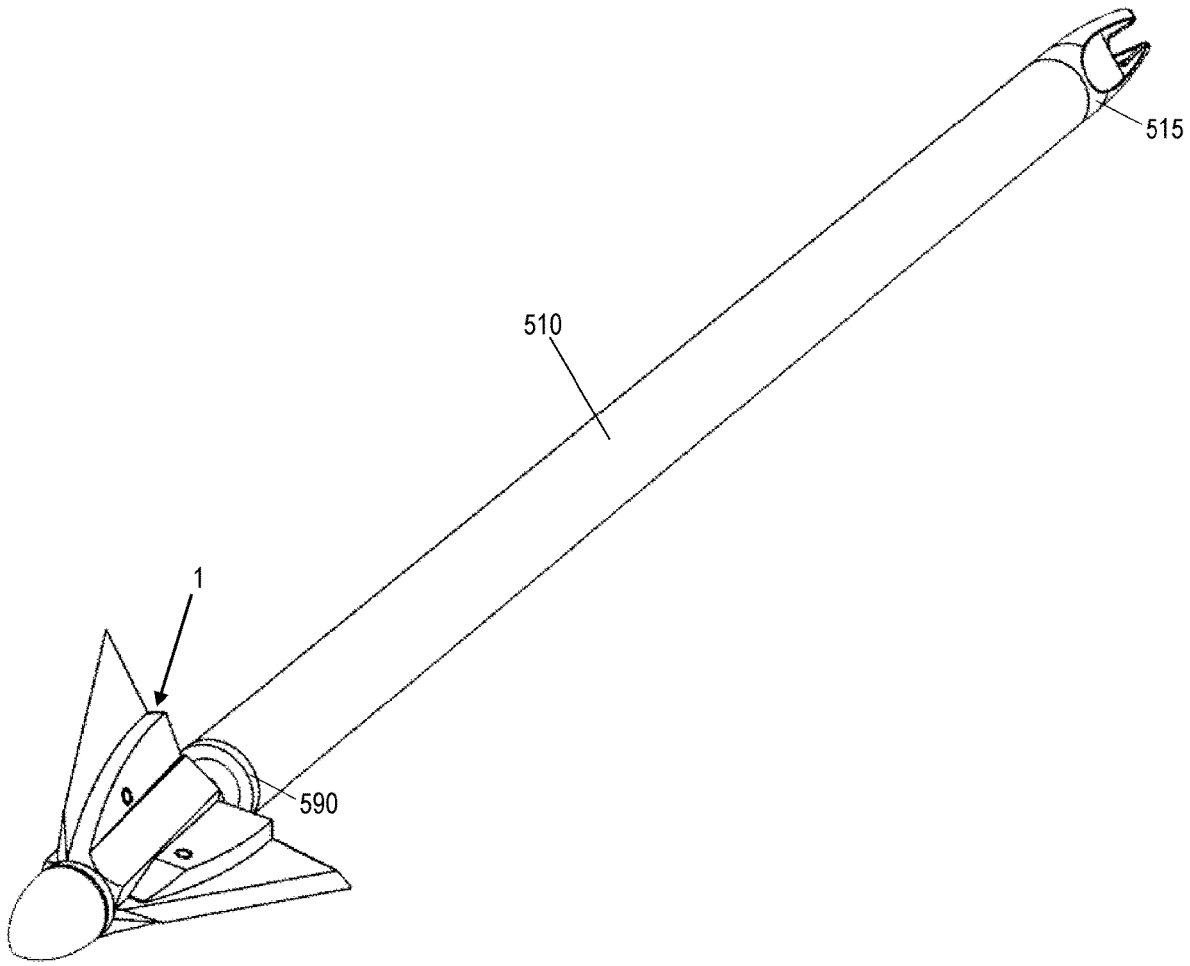
FIG. 1 shows a right side perspective view of an arrow including a pivoting arrowhead 1 designed in accordance with the present disclosure.

FIG. 1 shows a perspective view of an arrow consisting of a shaft 510, nock 515, and standard insert 590 which threadably receives a pivoting arrowhead 1.

Figure 2:
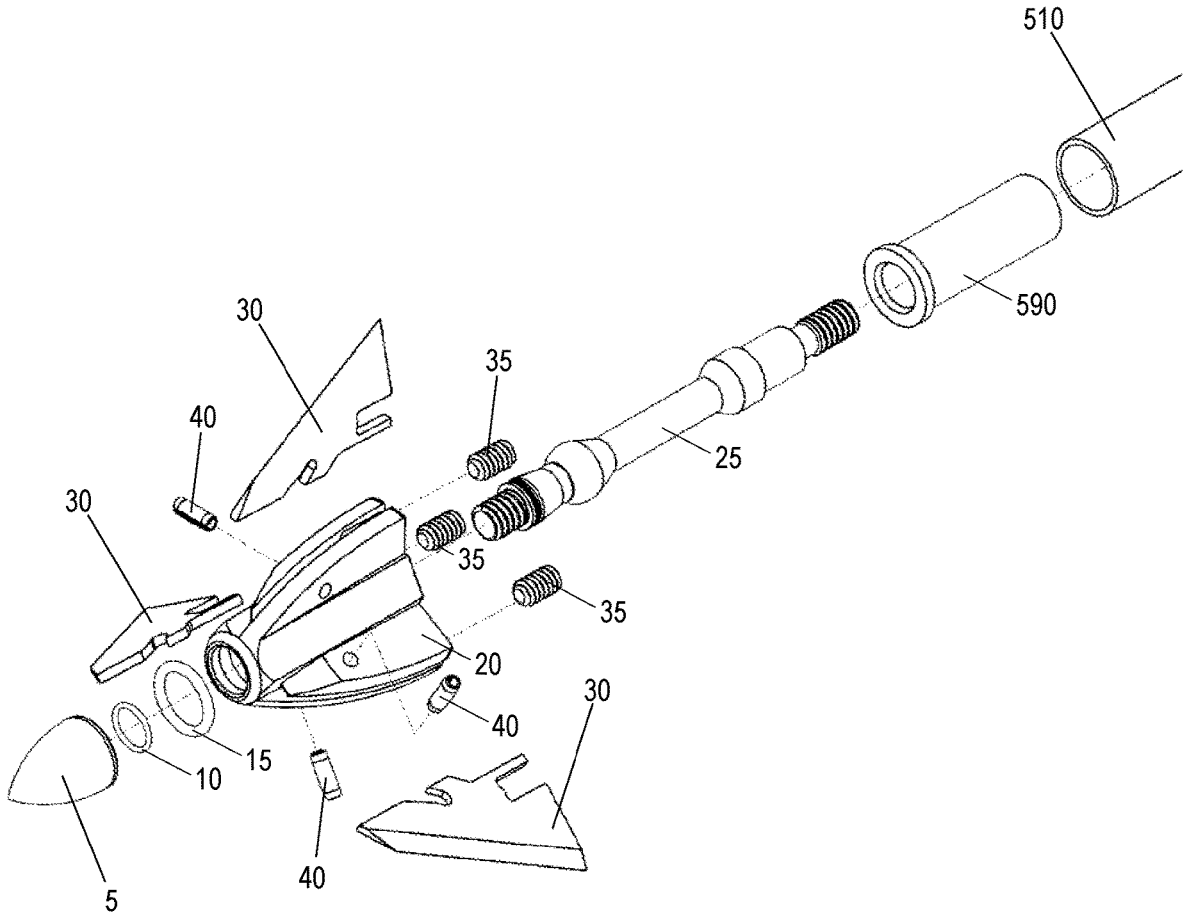
FIG. 2 shows a right side exploded view of the components of the preferred embodiment of the pivoting arrowhead.

FIG. 2 shows an exploded view of the components of a preferred embodiment of the pivoting arrowhead 1. The assembly consists of an arrowhead body 20 which is slotted to receive blades 30. The blades are mechanically fixed to the body by threaded fasteners 35 which axially compress the blades against transverse pins 40 inserted into the body. A large o-ring 15 is received by internal groove (not shown) inside the body, and these components are then slipped over the post 25 at assembly. The post is threaded on the distal end to receive the standard insert 590 which is inserted into and bonded or mechanically attached to shaft 590. A small o-ring 10 is received by a groove in the post located near the forward end of the post. The forward end of the post is threaded to receive the nosetip 5, which when assembled loosely captures the body onto the post. Note that even though a three-blade concept is used throughout this disclosure to illustrate the essential features of the pivoting broadhead arrowhead, the arrowhead is not limited to three-blade configurations only but may also be applied to two-blade configurations and configurations with greater than three blades.

Figure 3:
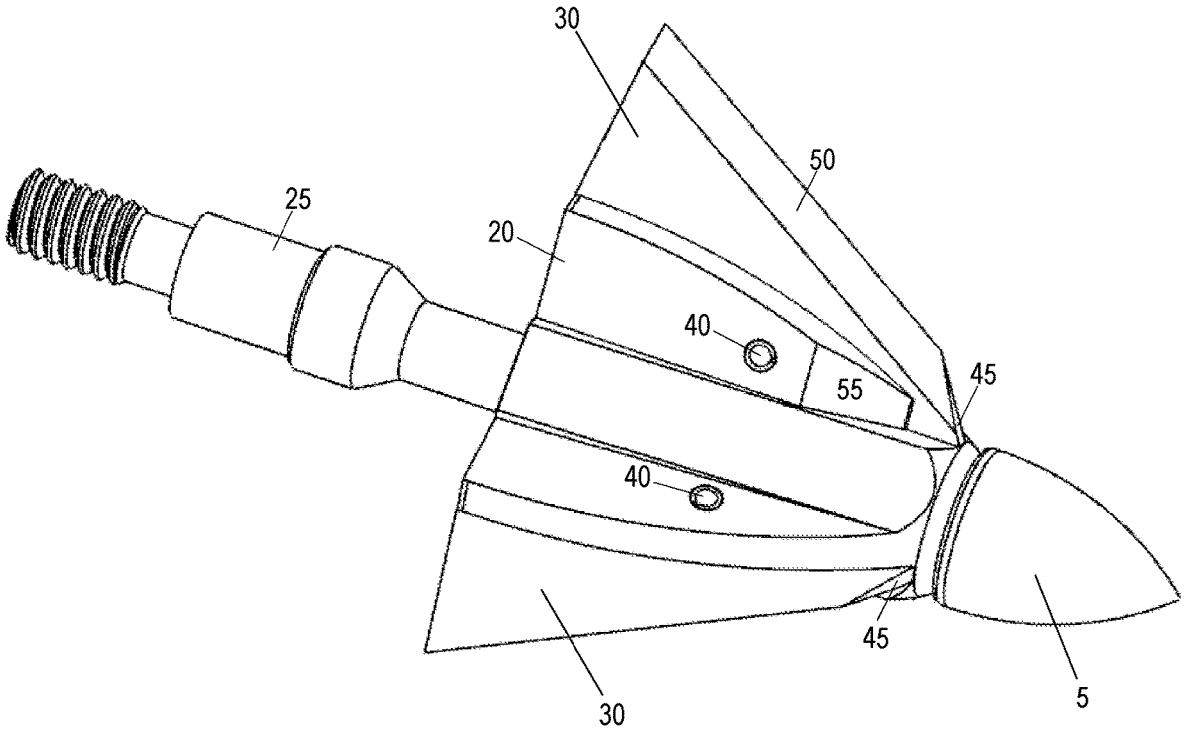
FIG. 3 shows a left side perspective view of assembled components of the preferred embodiment.

FIG. 3 shows the pivoting broadhead arrowhead in the assembled state consisting of the arrowhead body 20 with connected blades 30 surrounding the post 25 to which the nosetip 5 is attached.

Figure 4:
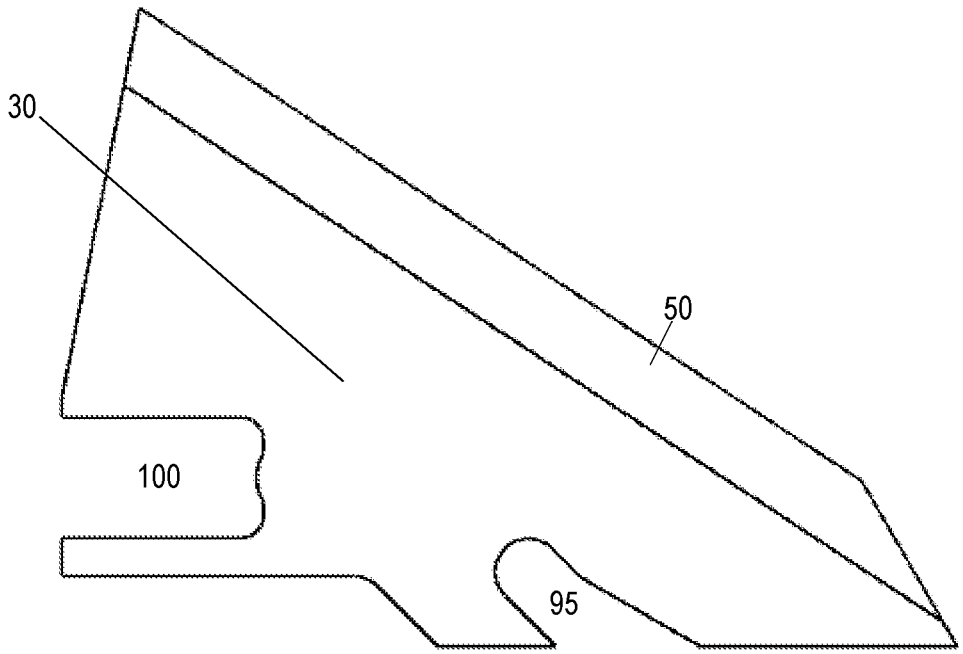
FIG. 4 shows a left side view of a broadhead arrowhead blade according to an embodiment of the present disclosure.

FIG. 4 shows details of a broadhead arrowhead blade 30 which include a cavity 100 to receive the threaded fasteners 35 (FIG. 1) and a cavity 95 to receive the pins 40 (FIG. 1). In this embodiment each blade features a bevel 50 only on the left side, which aids in rotation of the broadhead during flight. Inducing rotation into the pivoting motion of the broadhead is important as it aids in the overall accuracy of the arrow by roll-averaging any asymmetries induced during manufacture or assembly of the broadhead arrowhead components. The bevel 50 being located only on the left side aids the broadhead arrowhead in spinning clockwise when viewed from the front of the arrow, which tends to keep the right-hand threads of the post 25 (FIG. 1) tightly screwed to the standard insert 590 during flight.

Figure 5:
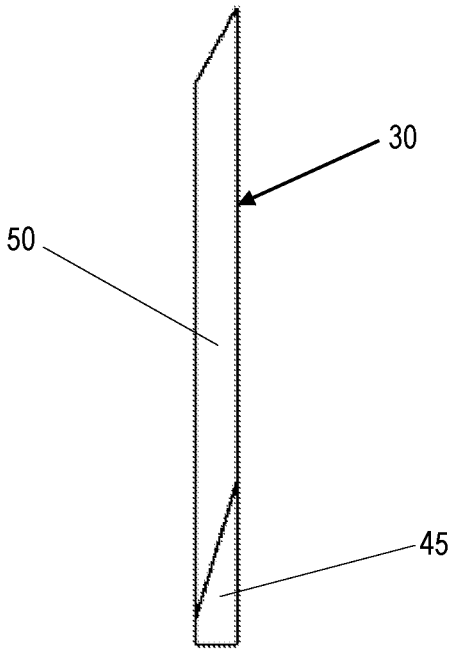
FIG. 5 shows a front view of a broadhead arrowhead blade according to an embodiment of the present disclosure.
Figure 6:
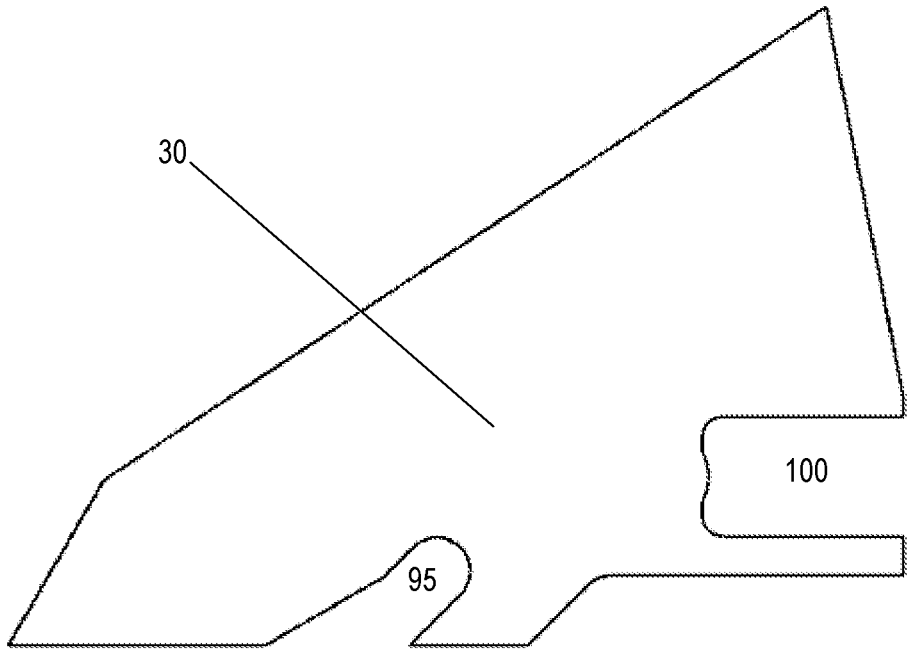
FIG. 6 shows a left side view of a broadhead arrowhead blade according to an embodiment of the present disclosure.

When the blade is viewed from the front as in FIG. 5, the roll-inducing aspect of the left-side single bevel 50 can be seen from the perspective of the relative oncoming wind. Also visible is the angled flat 45 of the blade. This blunted portion of the leading edge of the blade near the root of the blade eliminates blade damage during impact with hard objects such as bones, rocks, tree roots, etc. which otherwise tend to roll or break the unsupported near-body blade edge during impact. FIG. 6 shows the right side of the single bevel blade 30 indicating the lack of leading edge bevel on this side of the blade.

Figure 7:
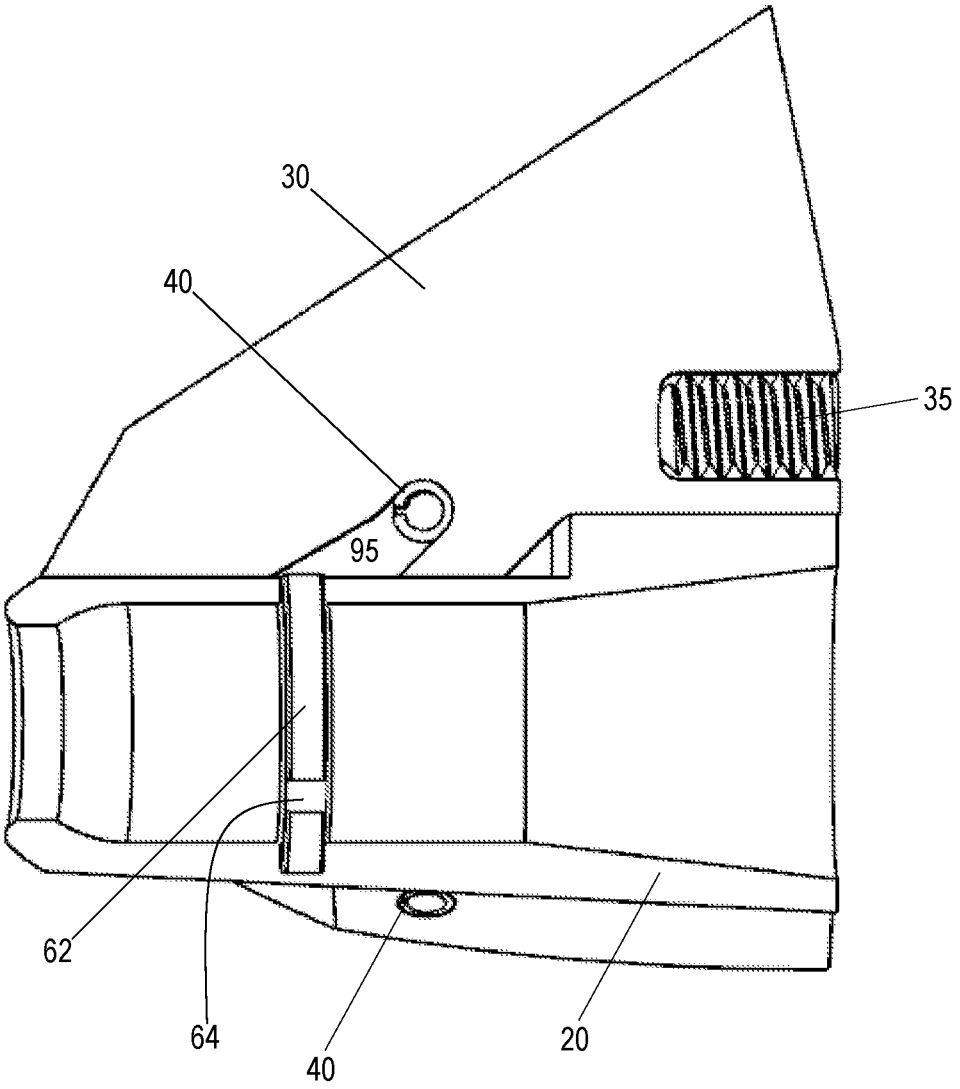
FIG. 7 shows a right side cutaway view of an embodiment of the present disclosure.
Figure 8:
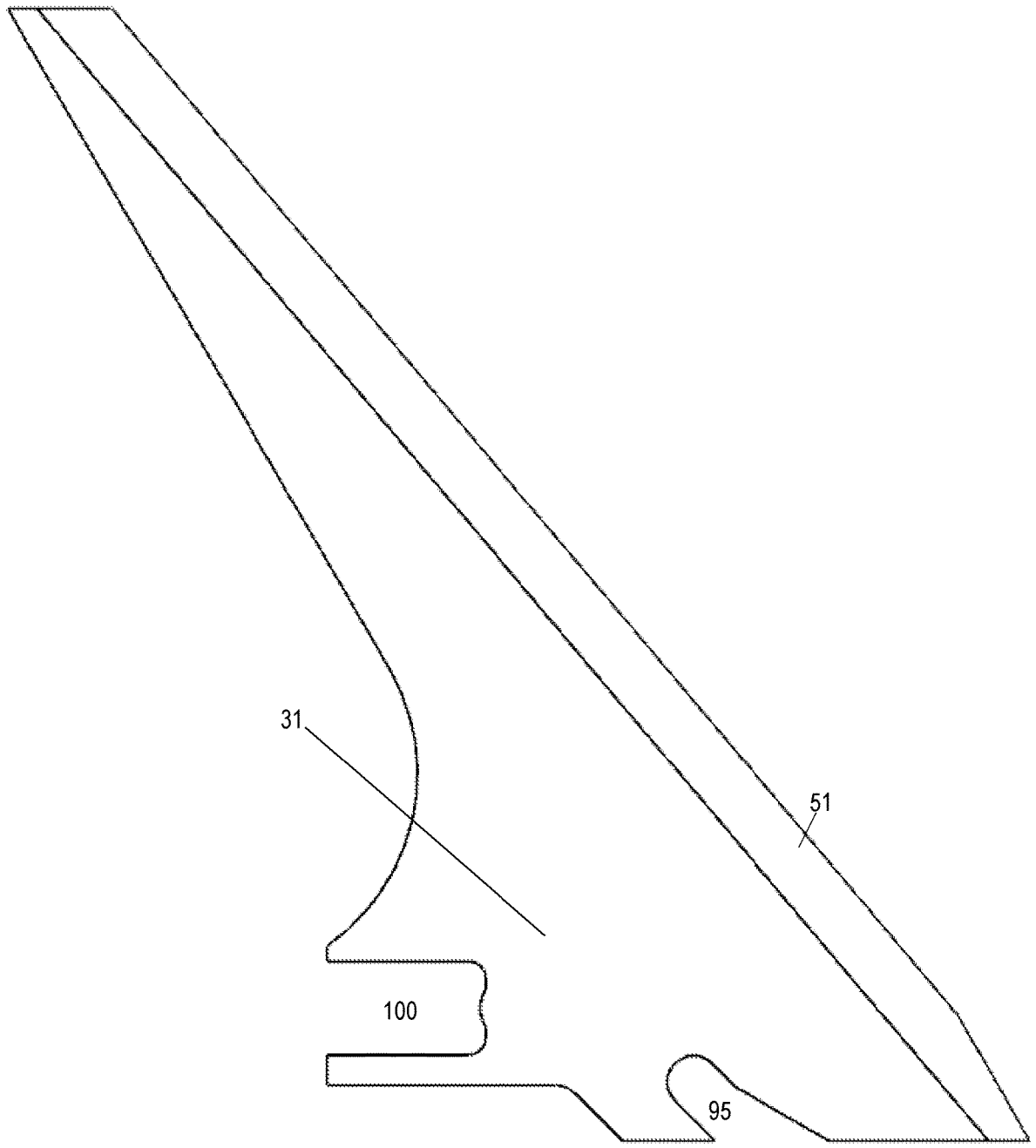
FIG. 8 shows a left side view of a broadhead arrowhead blade according to an embodiment of the present disclosure.
Figure 9:
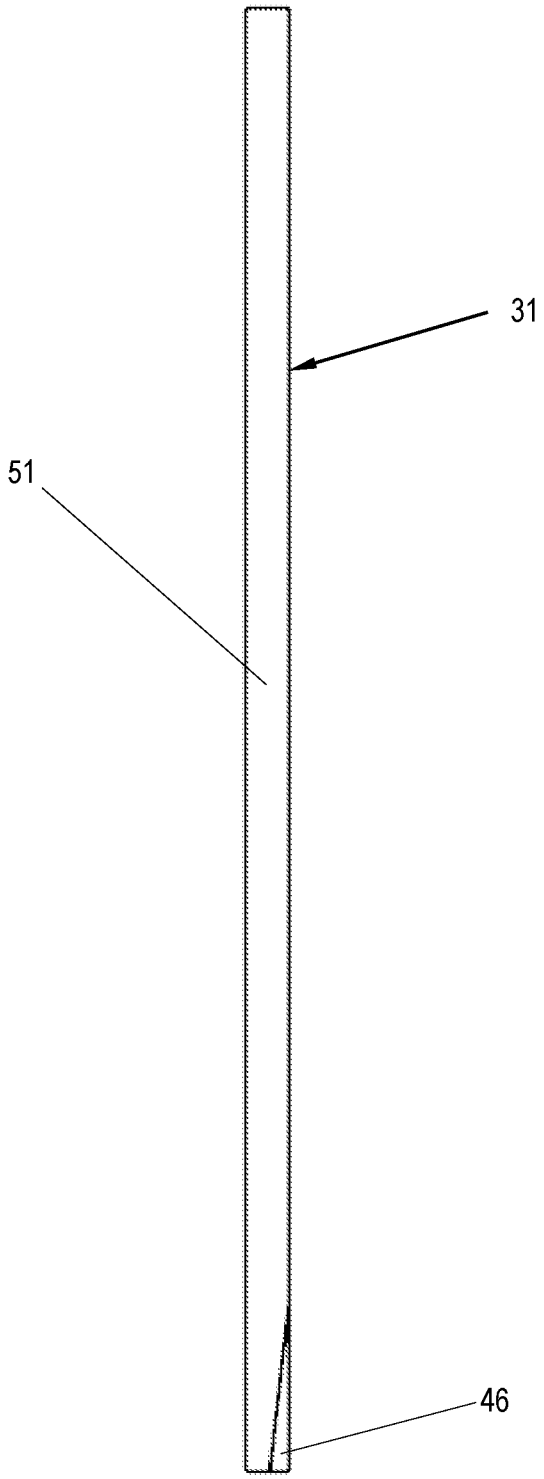
FIG. 9 shows a front view of a broadhead arrowhead blade according to an embodiment of the present disclosure.
Figure 10:
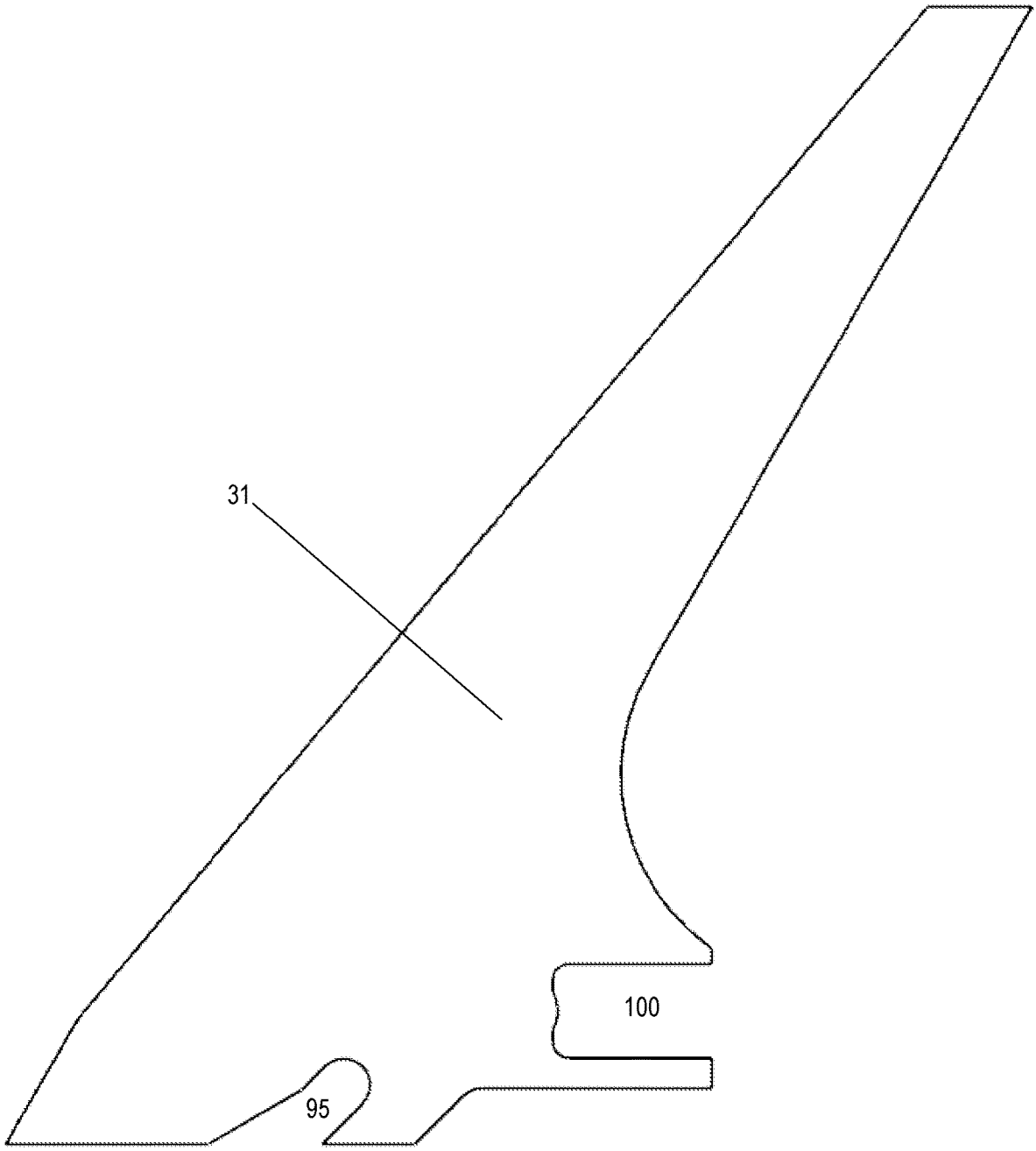
FIG. 10 shows a right side view of a broadhead arrowhead according to an embodiment of the present disclosure.

FIG. 7 shows a cutaway view of the body 20 and the assembled blade 30 of the broadhead arrowhead 1 indicating the method of blade attachment to the body. The threaded fastener 35 is received by the cavity 100 in the blade and upon tightening pushes the blade into pin 40 which is received by cavity 95 in the blade. In this manner the blade 30 is firmly held in compression to the body 20. The line of action of the threaded fastener 35 is offset from the axial centerline of pin 40, which causes a rotational moment about the pin and forces the blade to firmly seat against the body forward of the pin axis. Also shown is large o-ring groove 62 in body 20 and window 64 through body 20 which aids in removal and replacement of large o-ring 15 when o-ring replacement is needed.

Figure 11:
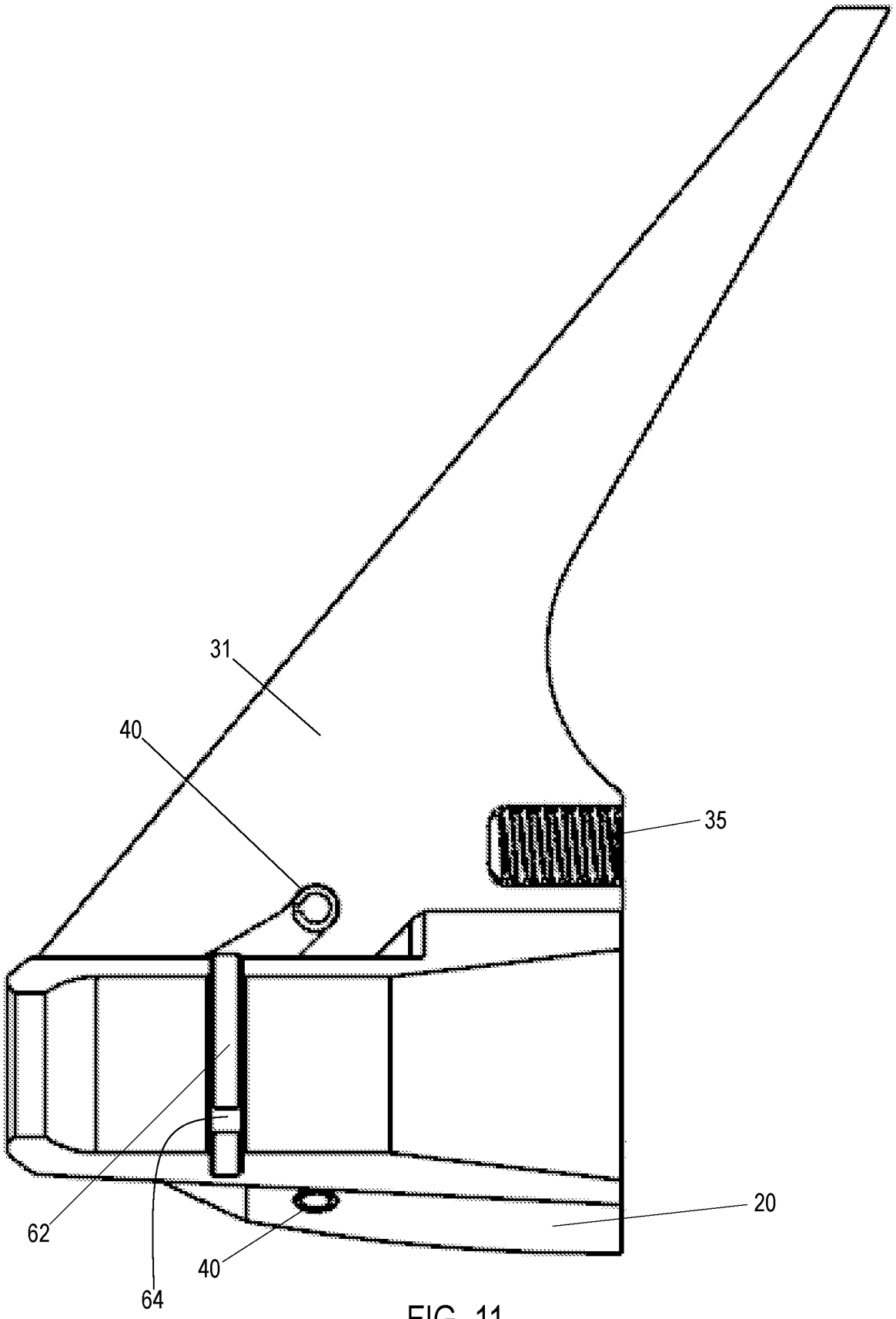
FIG. 11 shows a right side cutaway view of a broadhead arrowhead according to an embodiment of the present disclosure.

FIGS. 8-11 show another single bevel blade design 31 which spans a much larger assembled diameter than the blade design presented in FIGS. 4-7 (six inches versus 1.5 inches in the examples presented herein). The disparity in blade diameter takes advantage of a key characteristic of the pivoting broadhead arrowhead concept; that is, a set of arrowhead blades can be of any practical diameter without affecting the accuracy of the arrow. This key feature provides advantages to both the end-user and the manufacturer, in that replaceable blade sets may be selected and sold (respectively) based on the type of target or game being pursued. For example the particular blade shown in FIG. 8 may be more suitable for hunting game birds such as wild turkey, while the blade shown in FIG. 4 may be best suited for big game such as deer and elk, etc. Key features of the blade are retained, namely cavity 95, cavity 100, blade flat 46, and single bevel 51, and have been previously described. In particular the blade attachment method detailed in FIG. 11 is exactly the same as that shown in FIG. 7.

Figure 12:
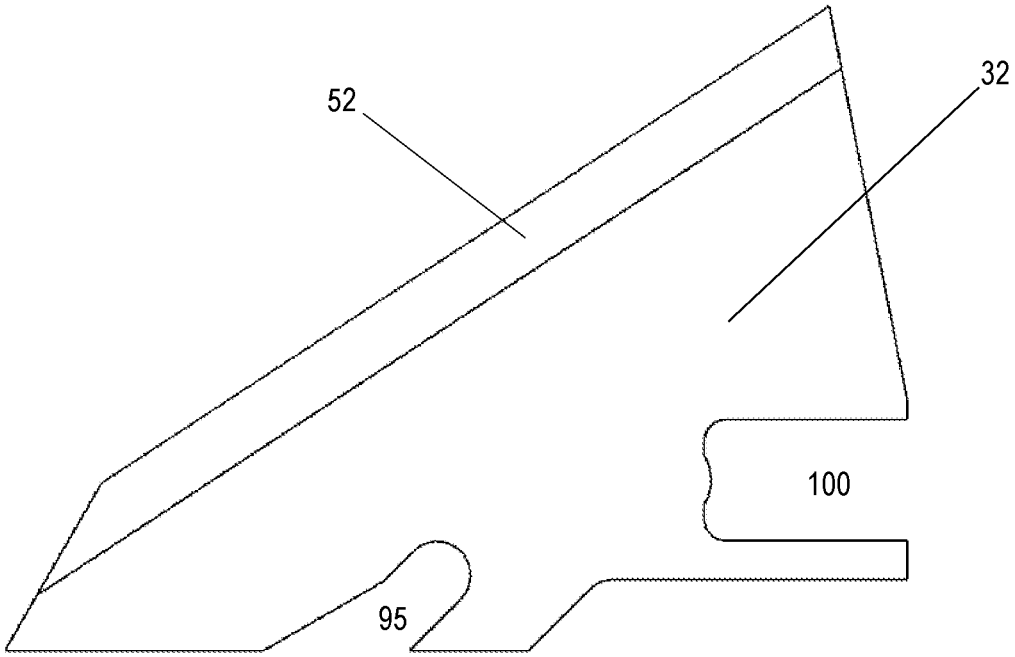
FIG. 12 shows a right side view of a broadhead arrowhead blade according to an embodiment of the present disclosure.
Figure 13:
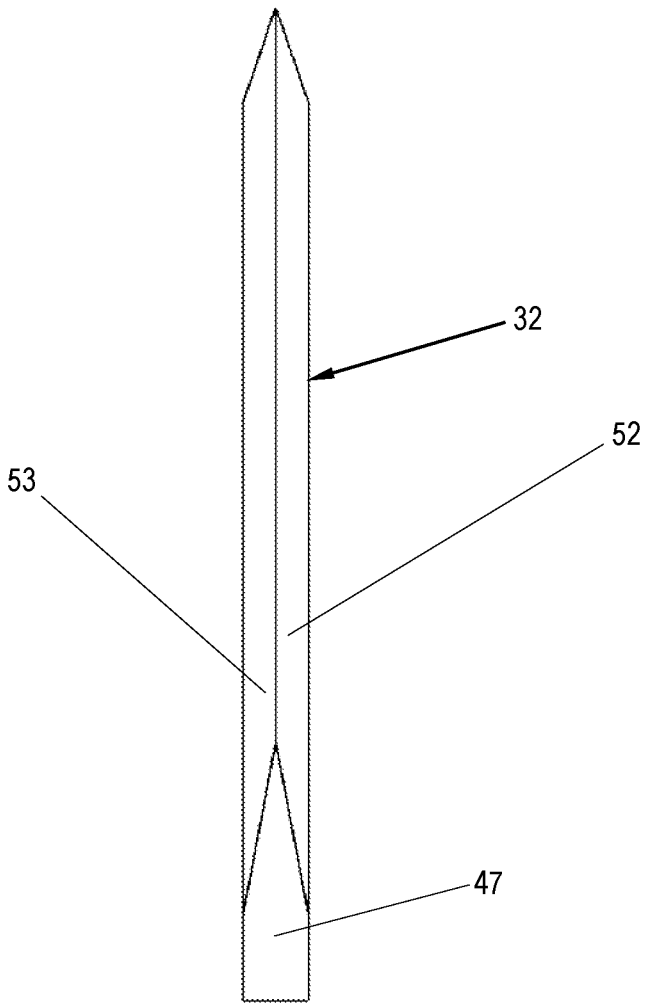
FIG. 13 shows a front view of a broadhead arrowhead blade according to an embodiment of the present disclosure.
Figure 14:
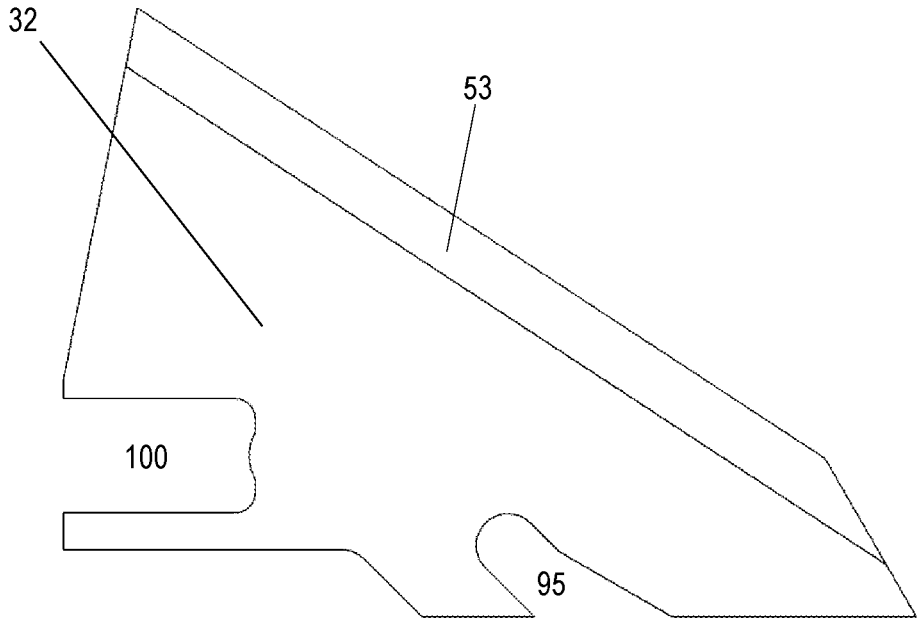
FIG. 14 shows a right view of a broadhead arrowhead blade according to an embodiment of the present disclosure.
Figure 15:
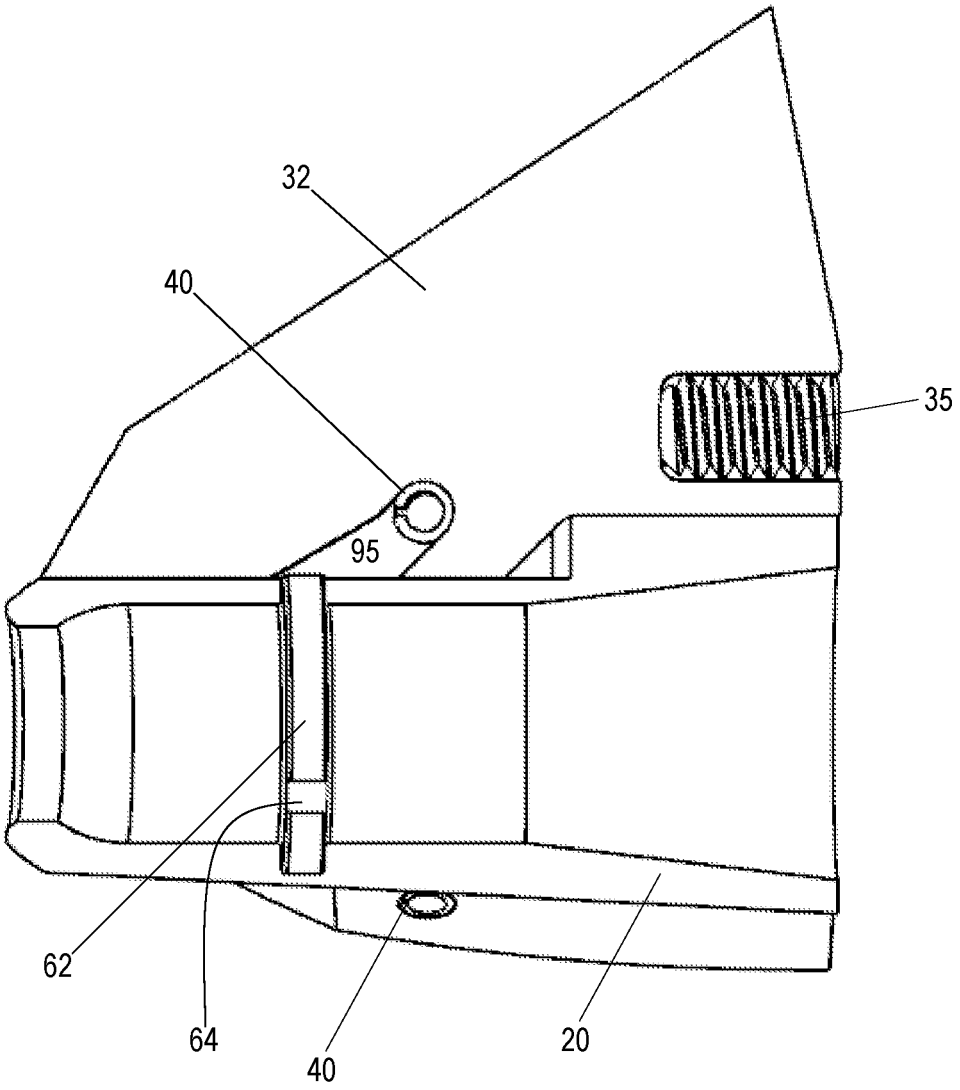
FIG. 15 shows a right side cutaway view of a broadhead arrowhead according to an embodiment of the present disclosure.

Although single bevel blades such as presented in FIGS. 4-7 and FIGS. 8-11 aid in producing rotational motion of the arrowhead which may enhance accuracy, the pivoting broadhead arrowhead concept is not limited to using single bevel blades. FIGS. 12-15 show a double bevel blade 32 which incorporates the same attachment features of cavity 95 and cavity 100, and the same leading edge blunting via a flat 47, as previously described. However, in this example, the blade contains a bevel both on the left side 52, and on the right side 53 as shown in FIGS. 12-14. As shown in FIG. 15, the attachment method of the double bevel blade is exactly the same as the single bevel blades shown in FIG. 11 and in FIG. 7 and described previously.

Figure 16:
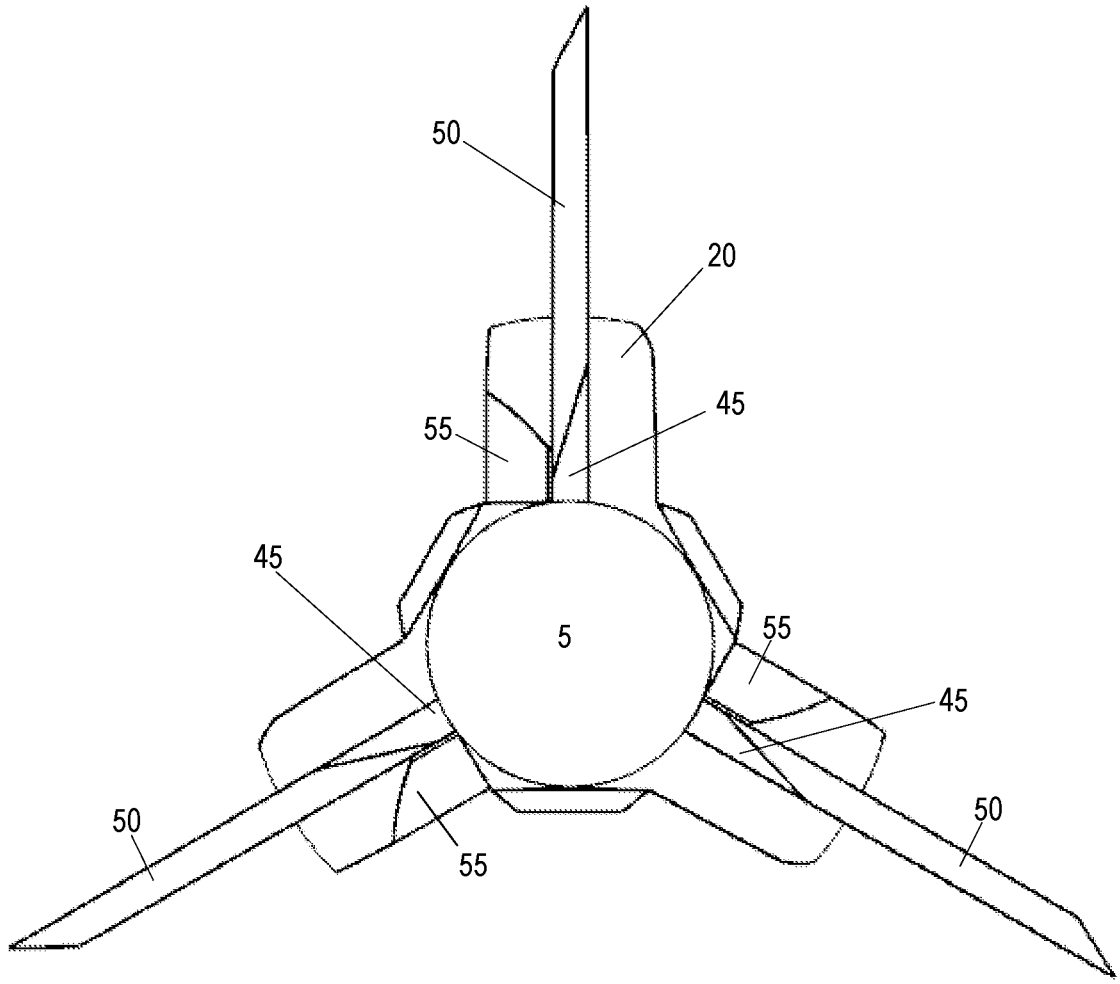
FIG. 16 shows a front view of a broadhead arrowhead according to an embodiment of the present disclosure.
Figure 17:
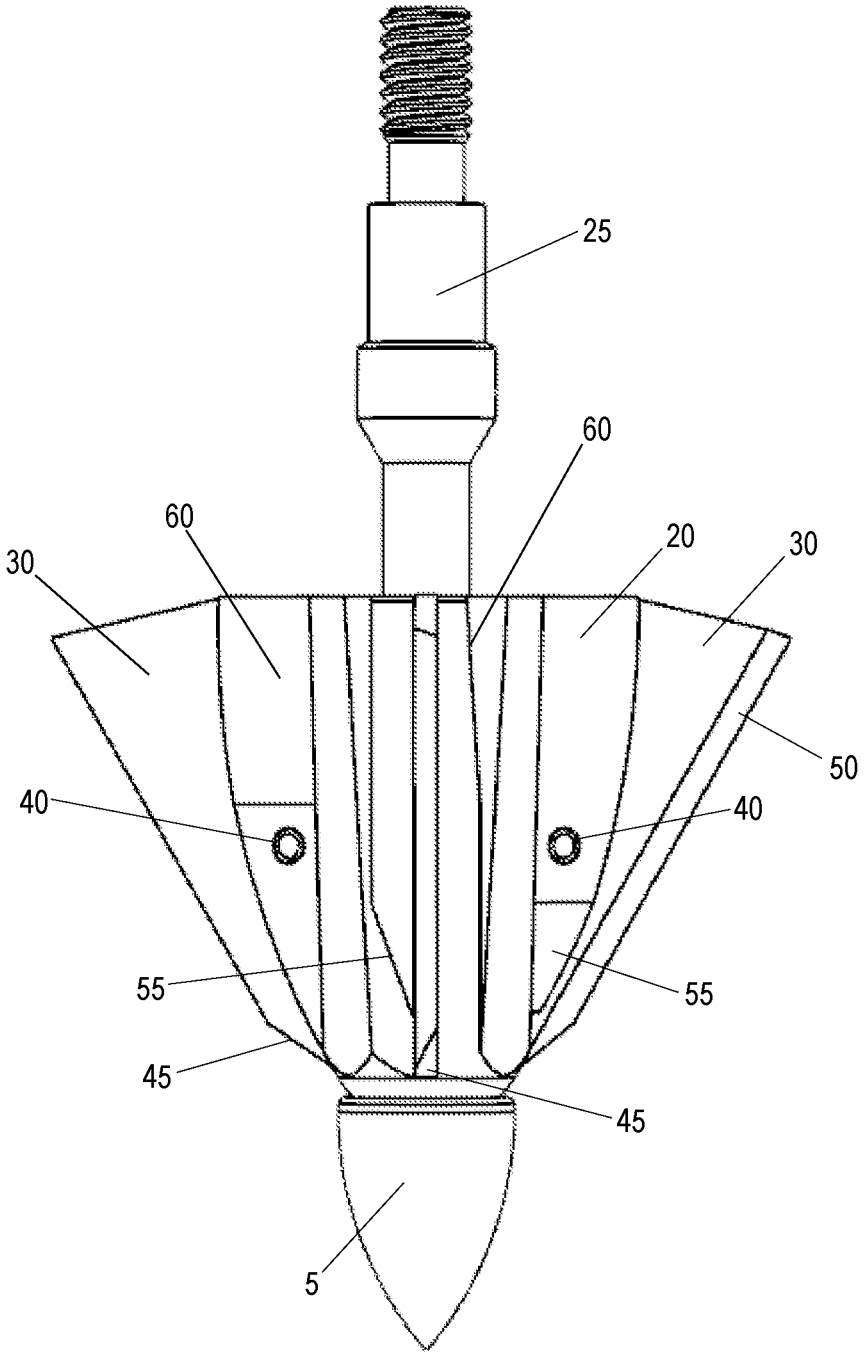
FIG. 17 shows a top view of a broadhead arrowhead according to an embodiment of the present disclosure.
Figure 18:
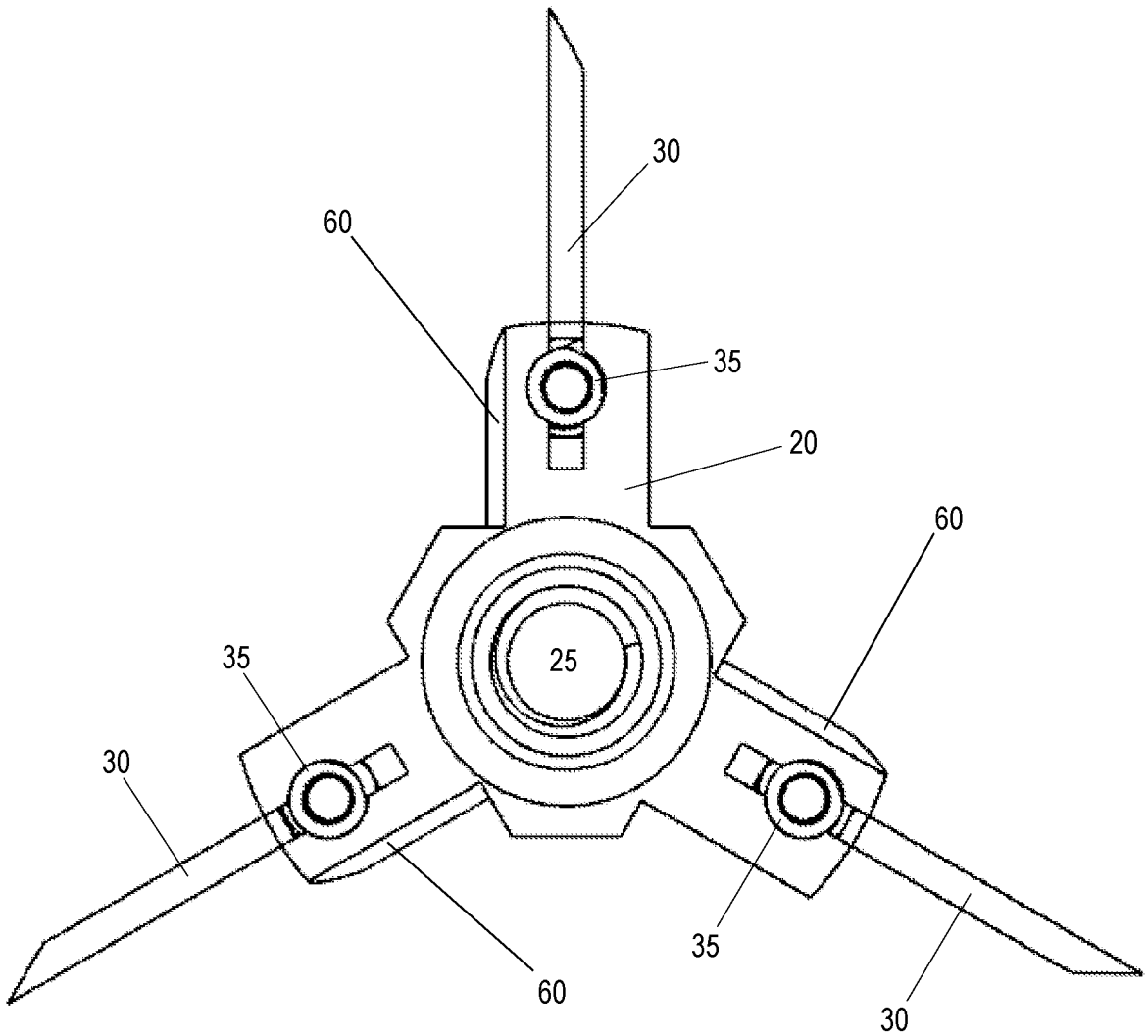
FIG. 18 shows a rear view of a broadhead arrowhead according to an embodiment of the present disclosure.

Rotation of the broadhead in flight may be accomplished regardless of the particular blade type (i.e. single or double bevel) chosen for use. FIGS. 16-18 show various features incorporated into the body itself which aid in producing rotational motion of the broadhead arrowhead. FIG. 16 and FIG. 17 show forward body bevels 55 added to body 20 to produce a rotational moment about the central axis of the arrowhead. Additionally FIG. 17 and FIG. 18 show rear body bevels 60 incorporated into body 20 which also aid in producing rotational motion of the arrowhead. The forward body bevels perform this function by creating a positive relative pressure on the body, while the rear body bevels 60 create a negative relative pressure on the body. Therefore both the forward body bevels 55 and the rear body bevels 60 work together to produce rotation about the central axis of the arrowhead in flight and also during the penetration event. In addition forward bevels 55 add pressure to spread the wound channel which helps to keep the wound channel open during and after the penetration event is complete.

Figure 19:
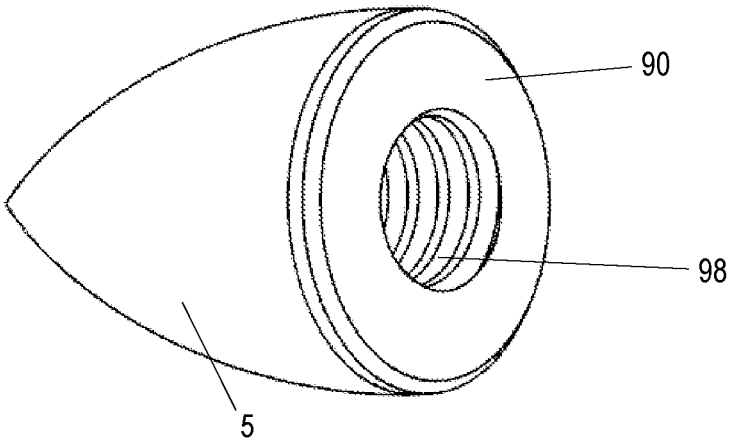
FIG. 19 shows a right side perspective view of a broadhead arrowhead nose tip according to an embodiment of the present disclosure.
Figure 20:
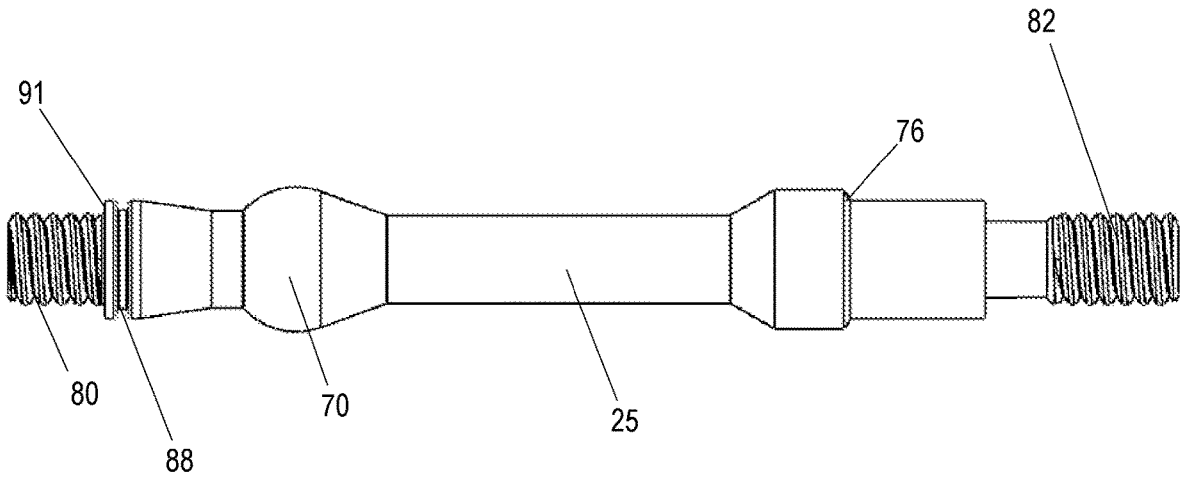
FIG. 20 shows a right side view of a broadhead arrowhead post according to an embodiment of the present disclosure.

In the preferred embodiment of the pivoting broadhead arrowhead, the nosetip 5 is threadably attached to post 25 via an internally threaded cavity 98 as shown in FIG. 19. When assembled, the flat surface 90 at the base of the nosetip contacts the flat surface 91 of the post 25 shown in FIG. 20 and provides a precise stop for the nosetip in relation to the post. The post acts as a backbone which rigidly ties nosetip 5 to the arrow shaft via threaded end 80, and threaded end 82 which mates with arrow shaft insert 590 (FIG. 2). Rear tapered surface 76 of post 25 interfaces with threaded insert 590 (FIG. 2) and provides precise axial alignment of the post in relation to the arrow shaft 510 (FIG. 2) when tightened.

The post incorporates both an integral bearing surface 70 and a small o-ring groove 88 which interface internally with arrowhead body 20.

Figure 21:
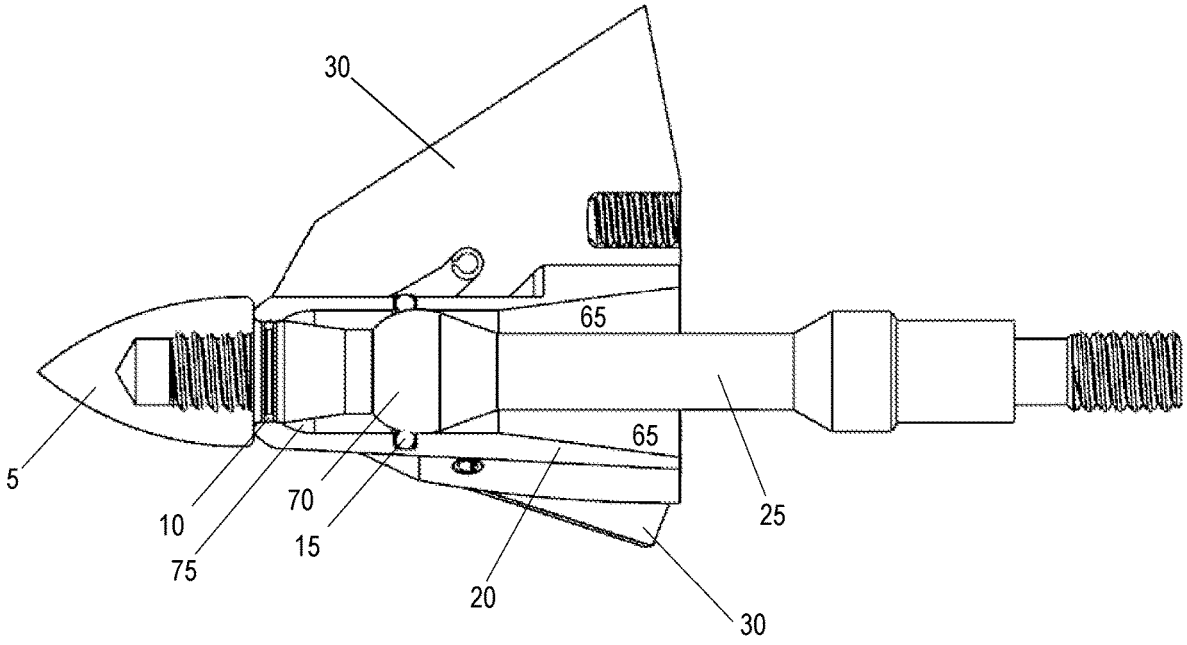
FIG. 21 shows a right side cutaway view of a broadhead arrowhead in accordance with an embodiment of the present disclosure.

FIGS. 21-25 detail the functioning of the assembled broadhead arrowhead 1 (FIG. 1). In FIG. 21, the assembled broadhead is shown in the launch condition with nosetip 5 and body 20 sectioned to reveal forward-located interior cavity 75 and rearward-located diverging cavity 65. The forward end of body 20 rests against the base of nosetip 5. Small o-ring 10 provides an interface between post 25 and interior cavity 75 of body 20 and also centers body 20 around post 25. Large o-ring 15 also provides a centering interface between post 25 and body 20 through integral bearing surface 70 such that the combined action of small o-ring 10 and large o-ring 15 serve to center the arrowhead on post 25 which provides for initial axial alignment of the arrowhead with shaft 510 immediately prior to launch. In this forward position, large o-ring 15 is compressed by and presses rearward against integral bearing surface 70 of post 25 which aids in keeping body 20 in contact with base of nosetip 5.

Figure 22:
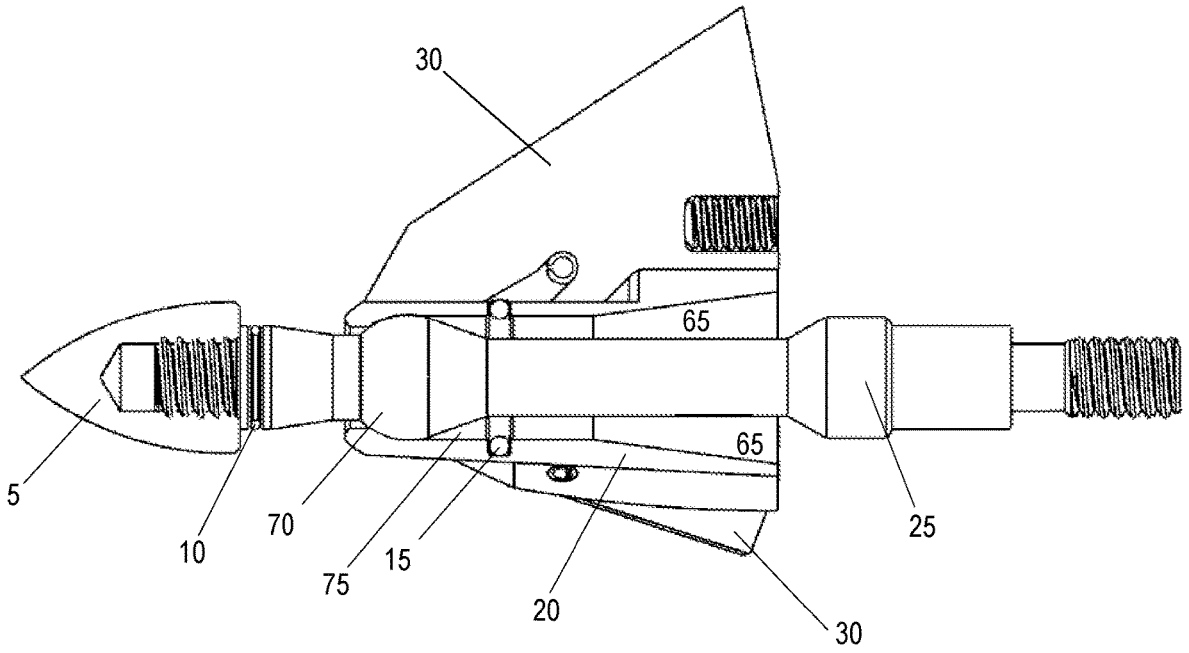
FIG. 22 shows a right side cutaway view of a broadhead arrowhead in accordance with an embodiment of the present disclosure.
Figure 23:
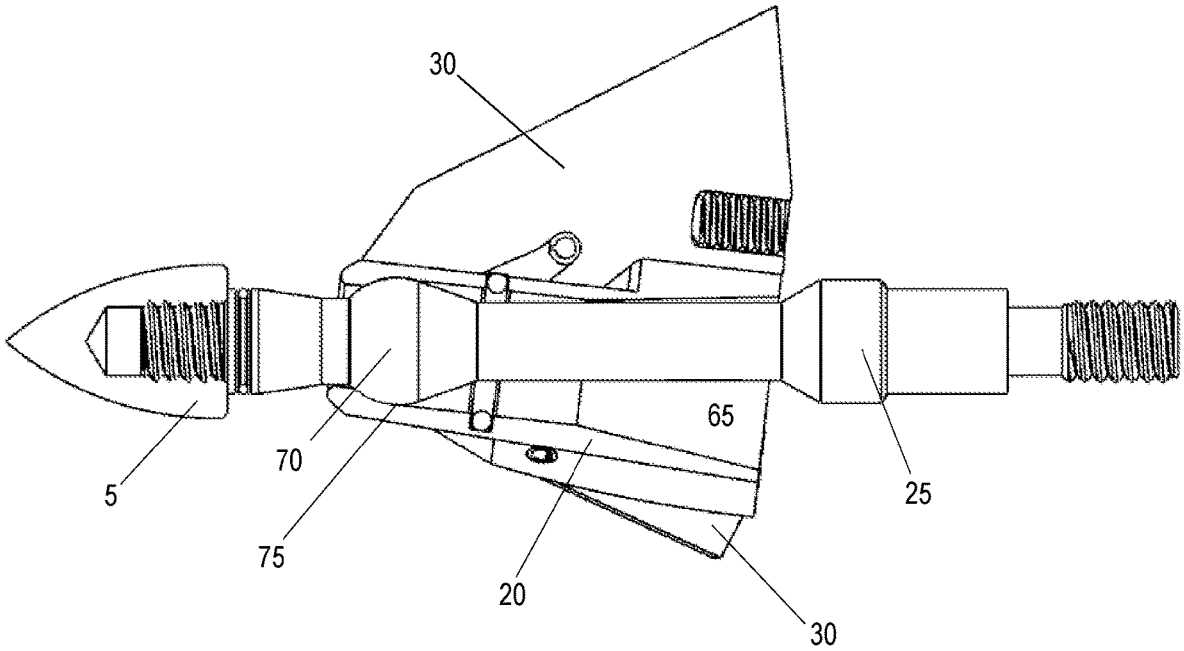
FIG. 23 shows a right side cutaway view of a broadhead arrowhead in accordance with an embodiment of the present disclosure.
Figure 24:
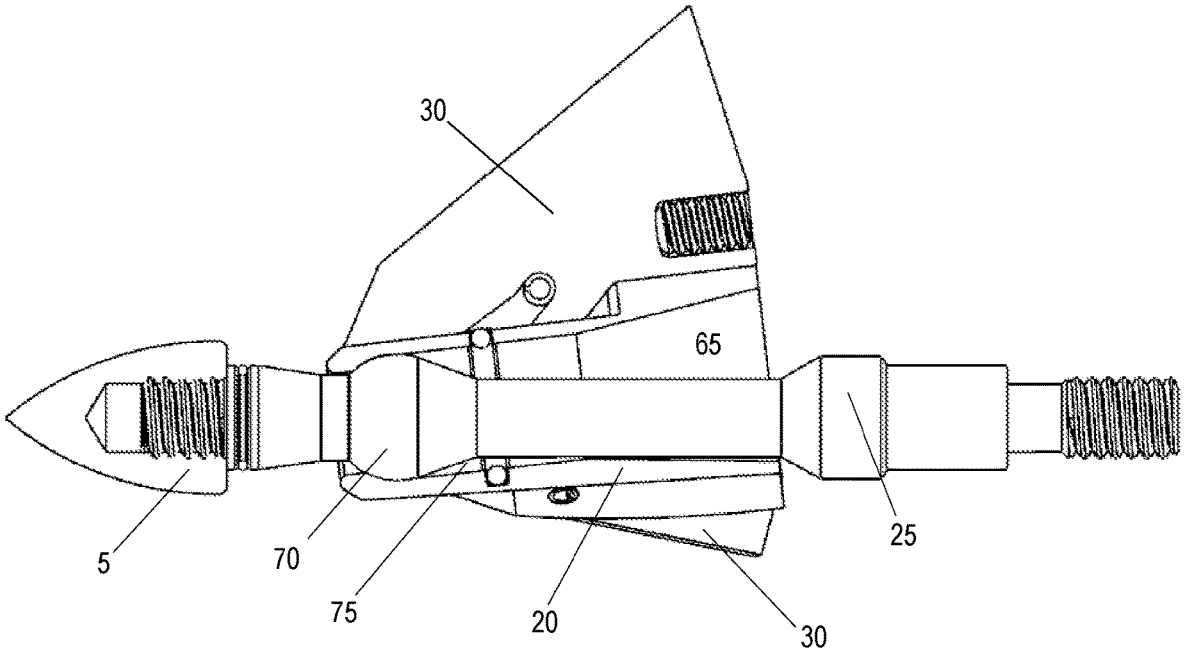
FIG. 24 shows a right side cutaway view of a broadhead arrowhead in accordance with an embodiment of the present disclosure.
Figure 25:
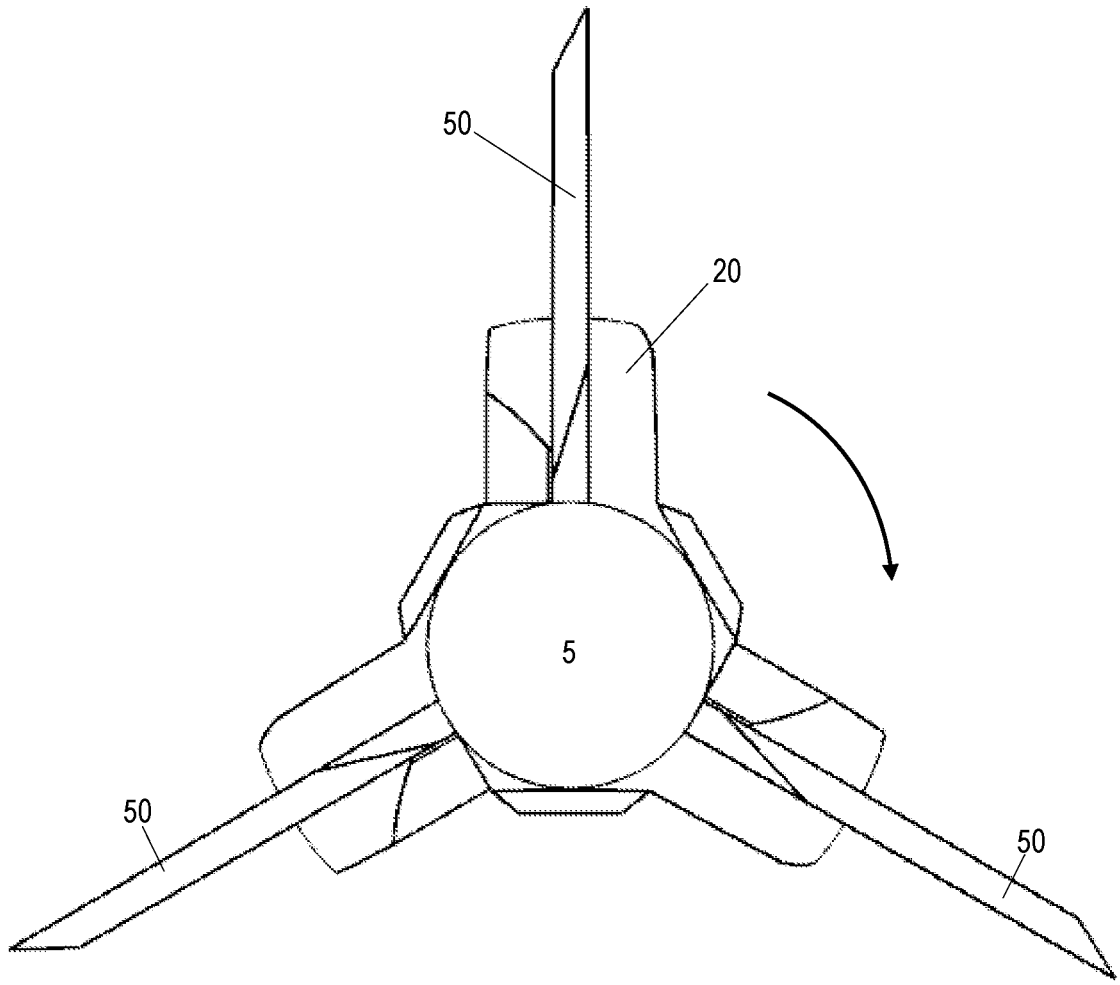
FIG. 25 shows a front view of a broadhead arrowhead in accordance with an embodiment of the present disclosure.

FIG. 22 details the relative position of the arrowhead body 20 immediately after the onset of launch. At this early time in the launch process, the integral bearing surface 70 of post 25 moves forward into the interior cavity 75 of body 20 overcoming the initial at-rest resistance provided by large o-ring 15. The integral bearing surface has come to rest against the forward end of interior cavity 75, and the body is now free to pivot only being constrained by the interface between the integral bearing surface 70 and the interior cavity 75, and intermittent line contact between the body walls of divergent cavity 65 and post 25. Such intermittent line contact is illustrated in FIGS. 23 and 24, where the arrowhead body 20 is shown pivoted to maximum limit both tail down in FIG. 23 and tail up in FIG. 24. It should be obvious that the arrowhead is free to pivot not just up or down as illustrated, but in any radial direction. As illustrated in FIG. 25, the arrowhead is also free to roll around post 25 simultaneously while pivoting. During target practice, the act of pulling the arrow from the target by grasping arrow shaft 510 allows target resistance acting on broadhead arrowhead 1 to automatically return the broadhead from its free flight condition shown in FIG. 22 to the pre-launch condition shown in FIG. 21. Furthermore, the central axis of broadhead arrowhead 1 becomes aligned with the central axis of arrow shaft 510 during the pulling action of the removal process, which eases the effort required to free the arrow from the target.

The launch and flight positions illustrated in FIGS. 21-25 indicate the key feature of embodiments of the present disclosure that simplifies both manufacture and operation compared to previous disclosures. In previous disclosures the nosetip was integrally attached to the arrowhead body and pivoted with the body such that the possibility of misalignment between the central axis of the arrow shaft and the central axis of the arrowhead body including nosetip may occur at or during impact. Because an arrow tends to follow the direction of the arrowhead nosetip during penetration, even a small initial deflection of the arrowhead body including nosetip could manifest into a large deflection of the entire arrow from the shotline. Various methods and devices were previously disclosed [hybrid CIP2] that allowed the arrowhead body including nosetip to re-align and then be held fixed in relation to the arrow shaft to minimize arrow deflection during penetration. In the present disclosure, the nosetip is rigidly attached to the arrow shaft, and only the body and the attached blades of the arrowhead are free to pivot as a unit. Deflection of the arrow such as when the arrowhead impacts bone asymmetrically is therefore reduced, as the nosetip remains aligned with the arrow shaft (and therefore also aligned with the pre-impact momentum vector of the arrow) even though the body with the attached blades may be deflected and be forced to pivotally rotate due to the asymmetrical bone strike. Embodiments of the current disclosure align and rigidly hold fixed the nosetip with the arrow shaft at all times, therefore the need for mechanisms that mechanically re-align and then hold the arrowhead body including nosetip in fixed relationship to the arrow shaft during penetration is eliminated.

Another embodiment of the present disclosure is revealed in FIGS. 26-32. Unlike broadhead arrowhead 1 of FIG. 3, broadhead arrowhead 2 presented in FIG. 26 does not unlock and slide rearward relative to arrow shaft 510 in order to pivot, but instead is free to pivot at all times without sliding rearward. Thus separate and independent means for initially aligning broadhead arrowhead 2 with shaft 510 for launch must be provided, and such means and mechanisms to accomplish initial alignment at launch were addressed in [hybrid CIP2]. The chief advantages of this embodiment over broadhead arrowhead 1 described in FIGS. 21-25 are lower system weight, less system complexity, and fewer components.

Figure 27:
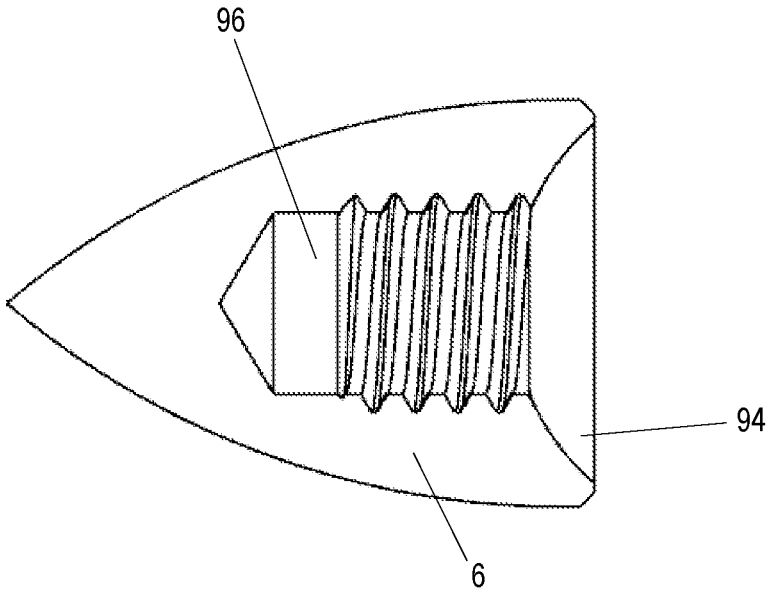
FIG. 27 shows a left side cutaway view of a broadhead arrowhead nosetip in accordance with an embodiment of the present disclosure.
Figure 28:
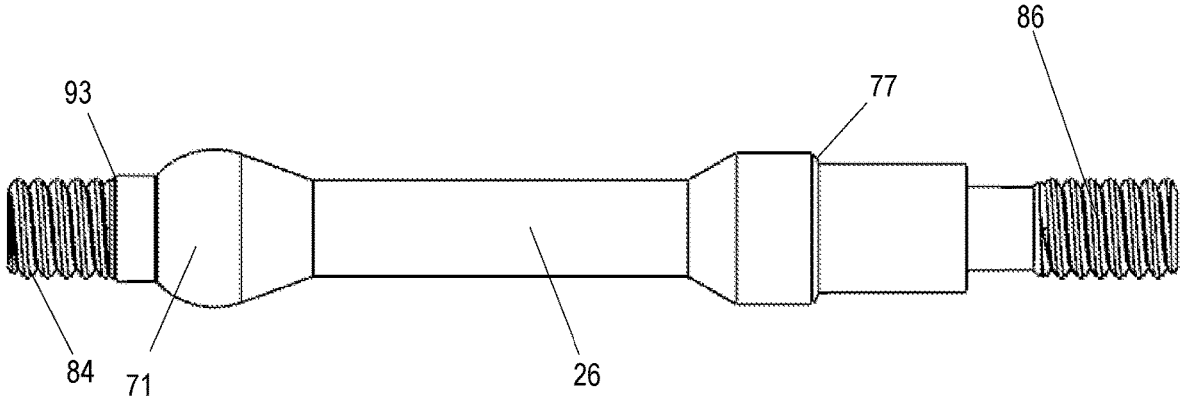
FIG. 28 shows a right side view of a broadhead arrowhead post in accordance with an embodiment of the present disclosure.

As shown FIG. 27, nosetip 6 contains a spherically shaped cavity 94 and a threaded cavity 96 which receives and is threadably connected to threaded end 84 of post 26 shown in FIG. 28, and is precisely located when cavity 94 of nosetip 6 comes to rest against forward surface 93 of post 26. Post 26 acts as a backbone which rigidly ties attached nosetip 6 to arrow shaft 510 (FIG. 2) via threaded end 86 which mates with arrow shaft threaded insert 590 (FIG. 2). Ear tapered surface 77 of post 26 interfaces with threaded insert 590 and provides precise axial alignment of the post in relation to the arrow shaft 510 (FIG. 2) when tightened. The post incorporates an integral bearing surface 71 which interfaces internally with arrowhead body 21.

Figure 26:
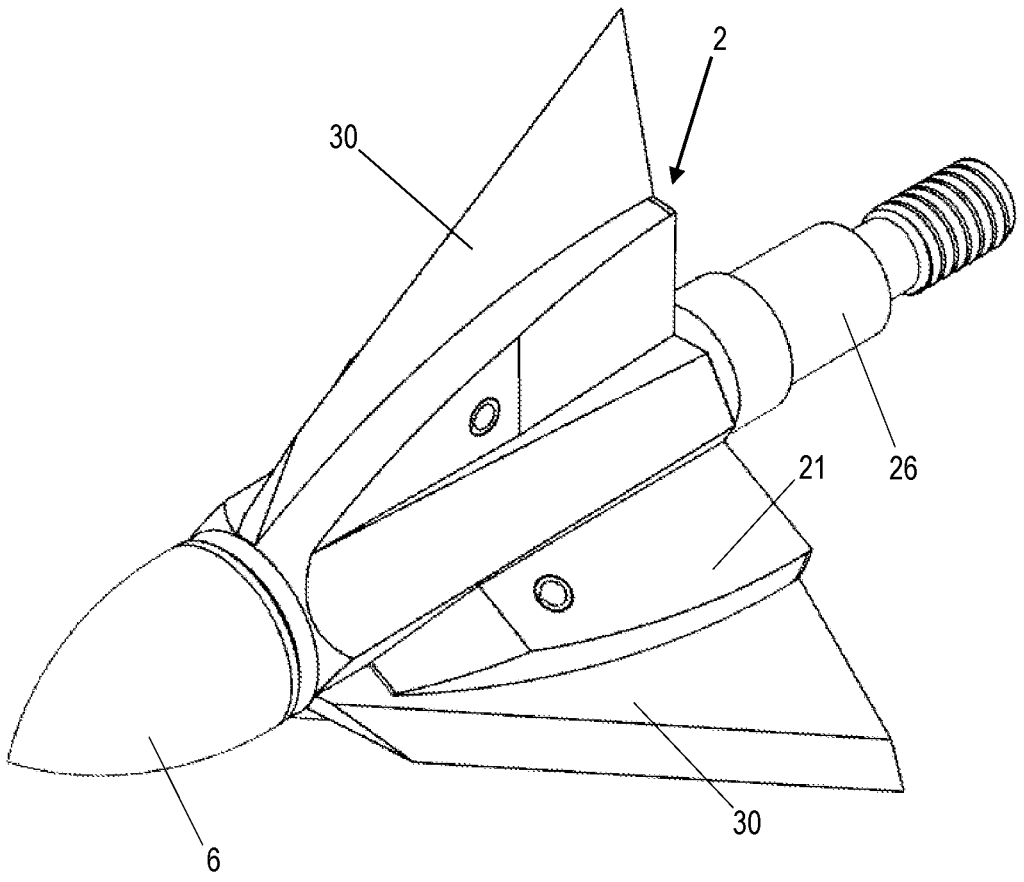
FIG. 26 shows a left side perspective view of a broadhead arrowhead in accordance with an embodiment of the present disclosure.
Figure 29:
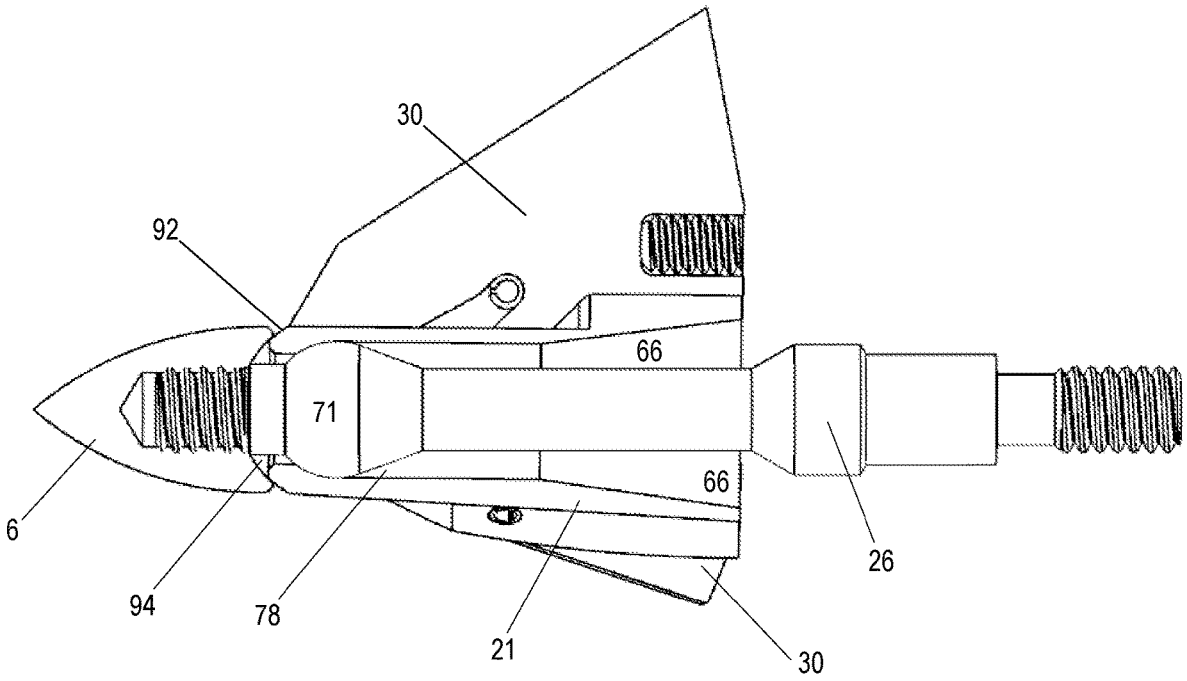
FIG. 29 shows a right side cutaway view of a broadhead arrowhead in accordance with an embodiment of the present disclosure.
Figure 30:
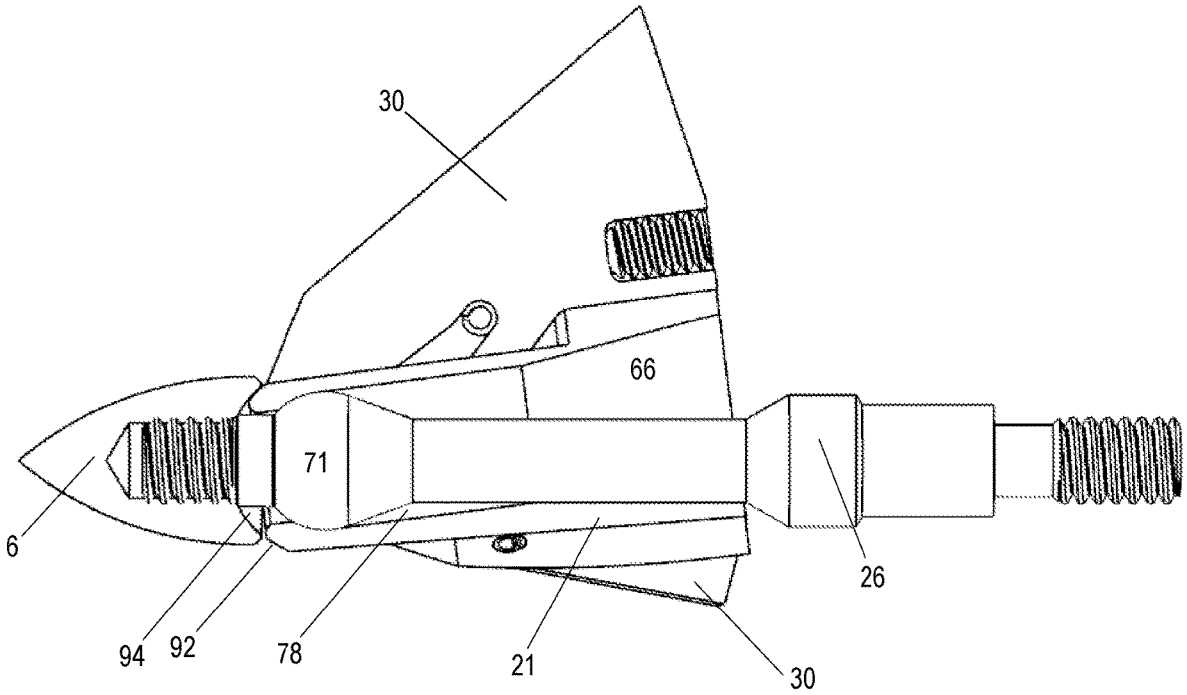
FIG. 30 shows a right side cutaway view of a broadhead arrowhead in accordance with an embodiment of the present disclosure.
Figure 31:
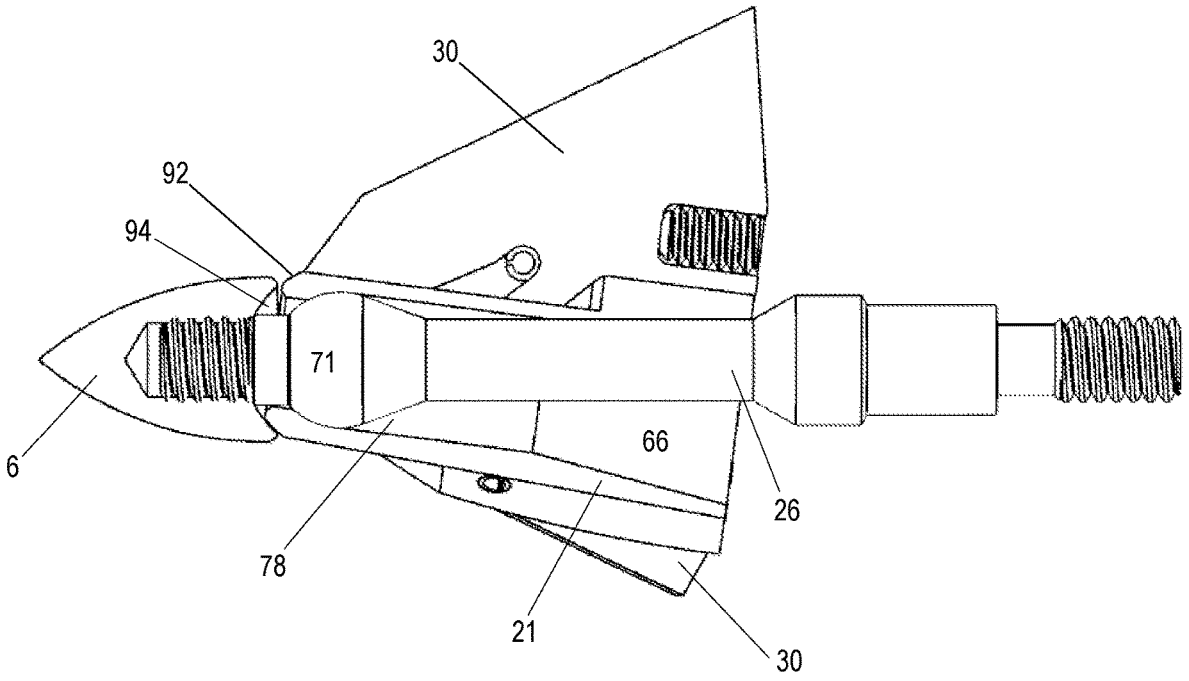
FIG. 31 shows a right side cutaway view of a broadhead arrowhead in accordance with an embodiment of the present disclosure.
Figure 32:
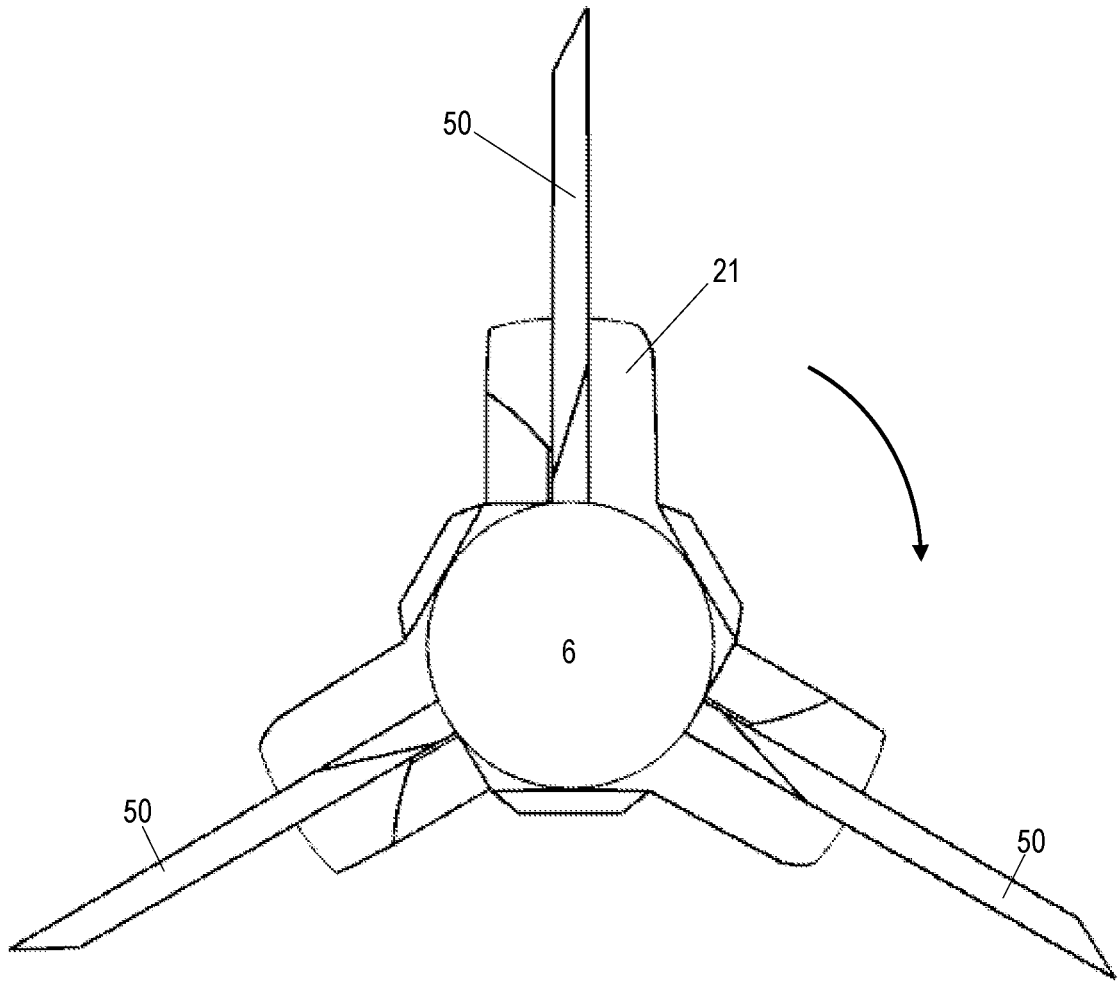
FIG. 32 shows a front view of a broadhead arrowhead in accordance with an embodiment of the present disclosure.

FIGS. 29-32 detail the functioning of the assembled broadhead arrowhead 2 (FIG. 26). In FIG. 29, the assembled broadhead is shown in the launch condition with nosetip 6 and body 21 sectioned to reveal forward-located interior cavity 78 and rearward-located diverging cavity 66 of body 21 and cavity 94 of nosetip 6. When assembled the spherical surface 92 of body 21, the spherical cavity 94 of nosetip 6, and the spherical surface of integral surface 71 of post 26 share the same pivot center allowing body 21 and attached blades 30 to pivot and rotate freely as a unit. FIG. 29 details the relative position of the arrowhead body 21 in relation to post 26 immediately after the onset of launch. The integral bearing surface 71 rests against the forward end of interior cavity 78, and the body is free to pivot only being constrained by the interface between the integral bearing surface 71 and the interior cavity 78, and intermittent line contact between the body walls of divergent cavity 66 and post 26. Such intermittent line contact is illustrated in FIGS. 30 and 31, where the arrowhead body 21 is shown pivoted to maximum limit both tail down in FIG. 30 and tail up in FIG. 31. It should be obvious that the arrowhead is free to pivot not just up or down as illustrated, but in any radial direction. As illustrated in FIG. 32, the arrowhead is also free to roll around post 26 simultaneously while pivoting.

Figure 33:
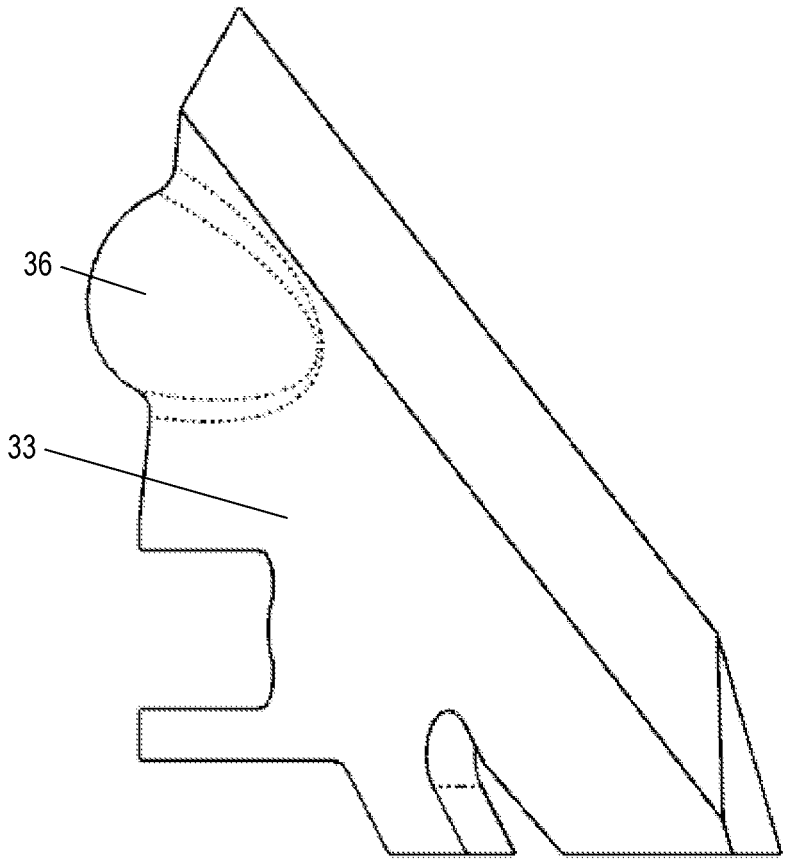
FIG. 33 shows a left side perspective view of a broadhead arrowhead blade in accordance with an embodiment of the present disclosure.
Figure 34:
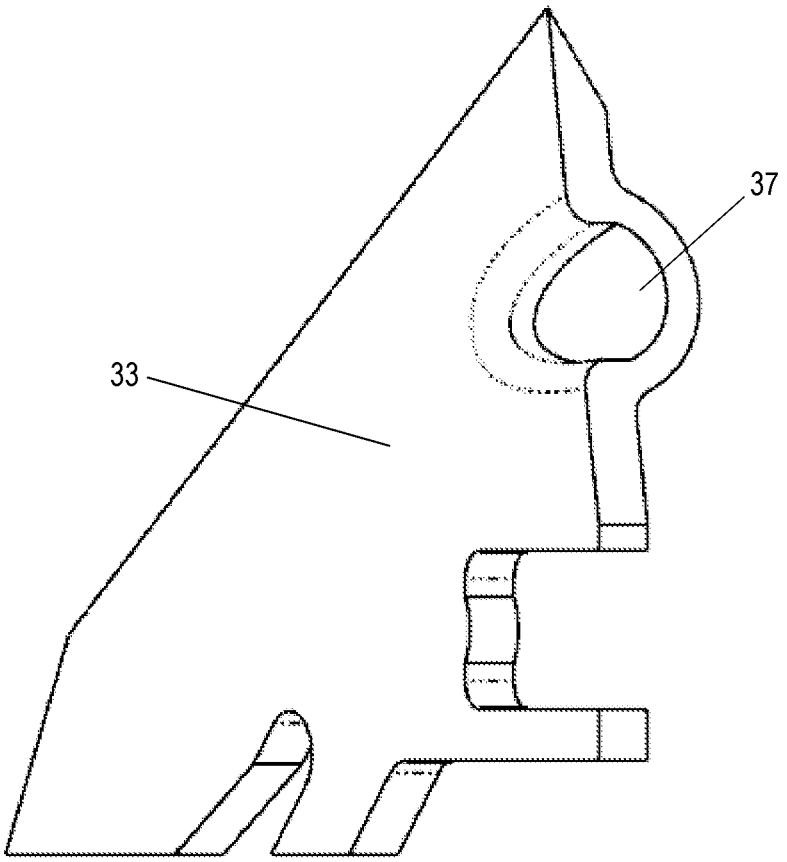
FIG. 34 shows a right side rear perspective view of a broadhead arrowhead blade in accordance with an embodiment of the present disclosure.
Figure 35:
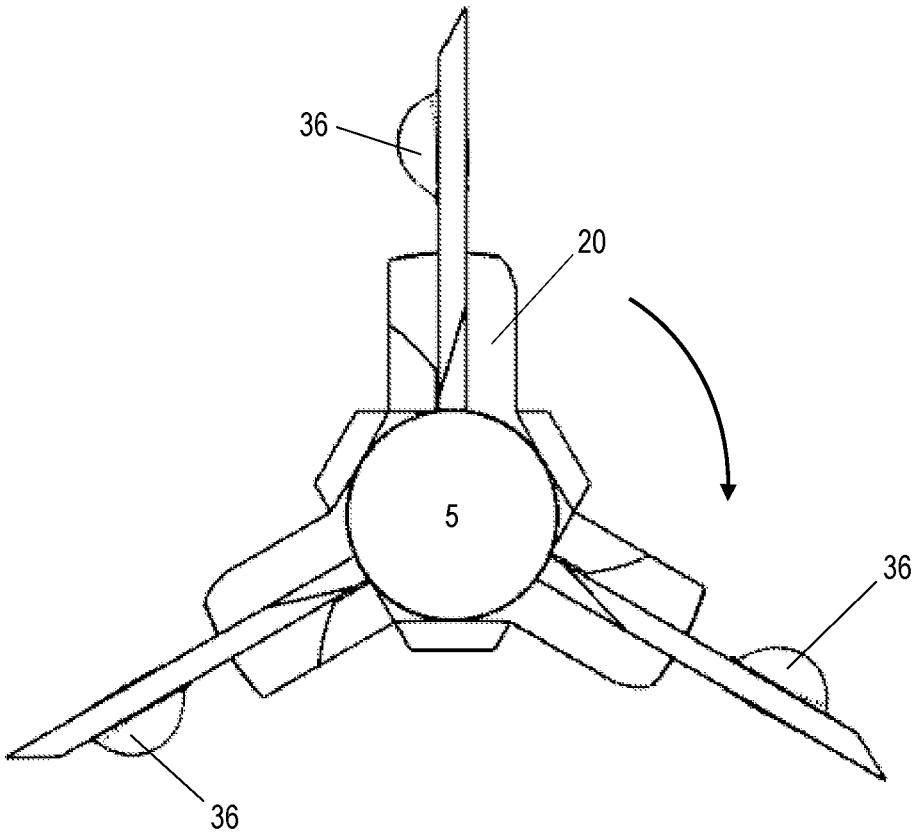
FIG. 35 shows a front view of a broadhead arrowhead in accordance with an embodiment of the present disclosure.
Figure 36:
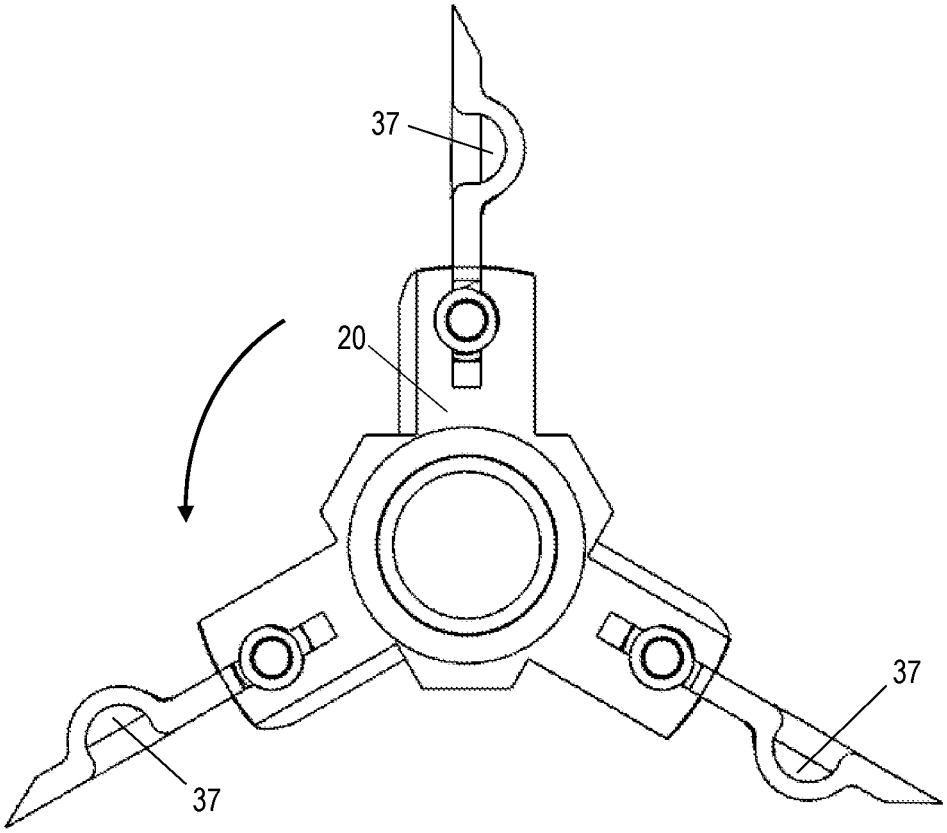
FIG. 36 shows a rear view of a broadhead arrowhead in accordance with an embodiment of the present disclosure.

Although single bevel blades such as presented in FIGS. 4-7 and FIGS. 8-11 offer a conventional aid in producing rotational motion of the arrowhead which may enhance accuracy, FIGS. 33-36 show a non-conventional blade embodiment that aids in rotation. In FIG. 33, the trailing edge of blade 33 has been plastically deformed into bulged surface 36 which aerodynamically causes an area of high pressure to be formed. Concomitantly, FIG. 34 shows that on the opposite side of the bulged surface, a cavity 37 is formed which aerodynamically causes a low pressure region to occur on that side of the blade surface. Together the high pressure caused by bulged surface 36 and the low pressure caused by cavity 37 act to create rolling motion of body 20 as shown from the front in FIG. 35 and from the rear in FIG. 36. Furthermore the bulge 36 and cavity 37 rather than being shaped through deformation of the blade 33, can alternatively be stamped or formed from a light-weight material and mechanically fastened or bonded to blade 33. Such a system may prove advantageous for weight reduction or conservation of blade material or for micro-adjustment of rotation rate of the broadhead during flight.

SUMMARY

In the current disclosure, means by which a pivoting arrowhead may reduce or eliminate deflection is put forth which eliminates the need for immobilizing the arrowhead body with respect to the arrow shaft during the penetration event, and therefore reduces the overall complexity of the pivoting arrowhead. Materials which can be used include, for the blades: carbon steel or stainless steel, for the body: steel, aluminum, or carbon composite, for the post: aluminum, titanium, or steel, for the nose: aluminum, titanium, or steel or combinations thereof, and for blade bulge inserts: steel, aluminum, plastic, or carbon composite or combinations thereof. Fabrication may take the form of conventional machining techniques combined with molding techniques and/or metal or plastic 3D printing methods. Alternative application of this technology may include cannon-launched high speed projectiles, bombs, rockets, harpoons, spears, atlatl, torpedoes or any other statically-stable projectiles that travel supersonically and/or subsonically through air or in water.

I claim:

1. An arrowhead assembly comprising:

a connector element configured to connect to a forward end of a shaft;

an arrowhead body movably connected to the connector element;

the arrowhead body including a center portion and a plurality of blades each extending from the center portion;

the center portion movable axially with respect to the connector element between a forward position and a rearward position;

when in the forward position the center portion being constrained against lateral movement with respect to the connector element; and when in the rearward position the center portion being enabled to move laterally with respect to the connector element.

2. An arrowhead assembly comprising:

a body, the body having at least two slots configured to each receive one blade;

two or more blades fixed to the body through a fastener, wherein the fastener is configured to axially compress the two or more blades against a transverse pin inserted into the body;

a large o-ring received in an internal groove within the body;

a small o-ring configured to be received by a groove in a post located near the forward end of the post; and a nosetip configured to couple the body with the post.

* * * * *